US006267370B1

(12) United States Patent
Ito et al.

(10) Patent No.: US 6,267,370 B1
(45) Date of Patent: Jul. 31, 2001

(54) INCLINING SLIDE FOR CARD DISPENSING DEVICE

(75) Inventors: Yukio Ito, Oi-machi; Yoshihisa Hirayama, Tsurugashima; Hideo Tanaka, Sakado; Takashi Imaizumi, Tsurugashima, all of (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/573,389

(22) Filed: May 18, 2000

Related U.S. Application Data

(62) Division of application No. 09/028,666, filed on Feb. 24, 1998, now Pat. No. 6,098,840.

(30) Foreign Application Priority Data

Feb. 26, 1997 (JP) ..... 9-42307

(51) Int. Cl.[7] ..... B65H 3/52

(52) U.S. Cl. ..... 271/138; 271/135; 271/131; 221/261

(58) Field of Search ..... 221/197, 268, 221/232, 259, 260, 261, 262; 271/132, 134, 135, 137, 138, 139, 140, 143

(56) References Cited

U.S. PATENT DOCUMENTS

| | | | | |
|---|---|---|---|---|
| 2,770,442 | * | 11/1956 | Malmros et al. | 271/138 |
| 3,955,092 | | 5/1976 | Hubert | 271/139 |
| 3,960,373 | | 6/1976 | Pacholok | 271/131 X |
| 4,151,987 | | 5/1979 | Toriumi et al. | 271/139 X |
| 4,227,687 | | 10/1980 | Schoonmade | 271/139 |
| 4,363,478 | * | 12/1982 | Tsukasaki | 271/138 X |
| 4,405,124 | * | 9/1983 | Watanabe | 271/135 |
| 4,783,064 | | 11/1988 | Hayashi . | |
| 4,789,079 | | 12/1988 | Kobayashi et al. . | |
| 5,176,237 | | 1/1993 | Yang | 221/259 X |
| 5,199,699 | | 4/1993 | Murad et al. | 271/131 |
| 5,364,195 | * | 11/1994 | Kanemitsu et al. | 271/138 X |
| 5,464,203 | * | 11/1995 | Bowser et al. | 271/138 X |
| 5,542,571 | * | 8/1996 | Belka | 221/268 |
| 5,611,456 | | 3/1997 | Kasper | 221/232 X |

FOREIGN PATENT DOCUMENTS

| | | |
|---|---|---|
| 58-034838 | 3/1983 | (JP) . |
| 58-071033 | 5/1983 | (JP) . |
| 58-075238 | 5/1983 | (JP) . |
| 58-075239 | 5/1983 | (JP) . |
| 58-090458 | 6/1983 | (JP) . |
| 58-090459 | 6/1983 | (JP) . |
| 58-094055 | 6/1983 | (JP) . |
| 58-094056 | 6/1983 | (JP) . |
| 58-094057 | 6/1983 | (JP) . |
| 58-100041 | 6/1983 | (JP) . |
| 58-026452 | 2/1984 | (JP) . |
| 59-064437 | 4/1984 | (JP) . |
| 59-064438 | 4/1984 | (JP) . |
| 59-064439 | 4/1984 | (JP) . |
| 60-142245 | 9/1985 | (JP) . |
| 60-142246 | 9/1985 | (JP) . |
| 3259833 | 11/1991 | (JP) . |
| 5073761 | 3/1993 | (JP) . |
| 5205139 | 8/1993 | (JP) . |
| 09278207 | 10/1997 | (JP) . |
| 9286552 | 11/1997 | (JP) . |

* cited by examiner

*Primary Examiner*—Christopher P. Ellis
*Assistant Examiner*—Patrick Mackey
(74) *Attorney, Agent, or Firm*—Varndell & Varndell, PLLC

(57) ABSTRACT

A card dispensing device has a mechanism for preventing double feeding of cards. The double feed preventing mechanism can be card attitude correction rollers, which adjoin the leading edges of the cards within the card dispensing unit and thickness screws to regulate the vertical dimension of the card feed route. The double feed preventing mechanism can be a plate having a leading edge extending into the card feed route to regulate the vertical dimension of the card feed route.

2 Claims, 25 Drawing Sheets

INCLINING SLIDE FOR CARD DISPENSING DEVICE

CROSS-REFERENCE TO RELATED APPLICATION

This application is a divisional application of Ser. No. 09/028,666 filed Feb. 24, 1998, now U.S. Pat. No. 6,098, 840.

BACKGROUND TO THE INVENTION

1. Field of the Invention

The present invention relates to a card-dispensing device wherein a plurality of telephone cards or similar comparatively thin prepaid cards are stacked and housed in such a manner as to be able to dispensed one by one from the very bottom of the device. In particular, it relates to such a card-dispensing device which offers greater compactness and improved dispensing speed.

2. Description of the Related Art

Automatic card vending machines which sell telephone cards and similar prepaid cards are normally provided within the casing with a card-dispensing device which dispenses cards in accordance with the amount of money inserted.

In general terms these card-dispensing devices consist of a card-housing unit in which a plurality of cards is stacked and housed, and a card-dispensing unit which ejects one by one the card which is at the very bottom of the stack of cards housed within the card-housing unit.

Unexamined Japanese Patent Publication (Kokai) No. 63-82246 previously filed in Japan by the same applicant of the basic Japanese application on which the present invention is based describes improvements which have been made to the slide which runs backwards and forwards within conventional card-dispensing devices. According to this publication, the slide engages during its forward run with the trailing edge of the bottommost card in the card-housing unit, and retains a horizontal attitude parallel with the card as it begins pushing the card towards the dispensing slot. Once it has pushed the card part of the way, it alters its attitude to an inclined one in order for the slide to be separated from the card. This is accomplished by allowing one end to fall freely, after which this inclined attitude is retained for a short time while the slide runs backwards. Finally, when the slide returns to its initial position, it simultaneously regains its horizontal attitude parallel with the cards. This makes it possible to avoid unnecessary contact between the slide during its inward run and the card which is now bottommost in the card-housing unit and next to be dispensed, thus reducing scratches and other damage to the cards as far as is feasible.

However, the conventional card-dispensing device which is described above makes use of a configuration whereby the slide, which engages with the trailing edge of the card and pushes it in a horizontal direction, falls freely under its own weight during its forward run. This means that any adhesion of dirt to the member which supports the slide, or to any other member, not only impedes its smooth free-falling action and renders it unstable, but has the added disadvantage of causing the slide to lock, thus interfering with the stable dispensing of cards.

Another difficulty inherent in the conventional device is the slowness with which the slide modifies its attitude. This results from the configuration whereby the slide falls freely under its own weight, and stands in the way of any further improvement in the speed of dispensing cards.

Yet another problem with the conventional device involves the slide regaining its horizontal attitude parallel with the cards after executing the inward run in inclined attitude. The structure adopted is such that a lever is employed to lift one end of the slide against the other, which requires a fair amount of space in the direction in which the slide runs backwards and forwards, thus presenting an obstacle in the way of designing more compact card-dispensing devices.

SUMMARY OF THE INVENTION

It is an object of the present invention to provide a more compact card-dispensing machine which also offers increased stability and speed in dispensing cards.

With the purpose of achieving the above object, the present invention is a card-dispensing device having a card-housing unit wherein a plurality of cards is stacked and housed, and a slide which runs backwards and forwards with the aid of the means of driving it, the slide modifying its attitude during the forward run from a horizontal one, wherein it is parallel with the plurality of cards stacked and housed within the card-housing unit in such a manner as to come into contact with the bottommost card thereof and cause it to be ejected, to an inclined one wherein by rotating through a prescribed angle it is separated from the card, regaining during the inward run its initial horizontal attitude wherein it is parallel with the cards, characterised in that it is provided with means of modifying the attitude of the slide, whereby during the forward run of the slide its attitude is forcibly modified from a horizontal one (wherein it causes the card to be ejected) to an inclined one, and whereby during the backward run it is forced to regain its said horizontal attitude.

DESCRIPTION OF THE PREFERRED EMBODIMENTS

There follows a detailed description on embodiments of the card-dispensing device to which the present invention pertains.

Figure 1:
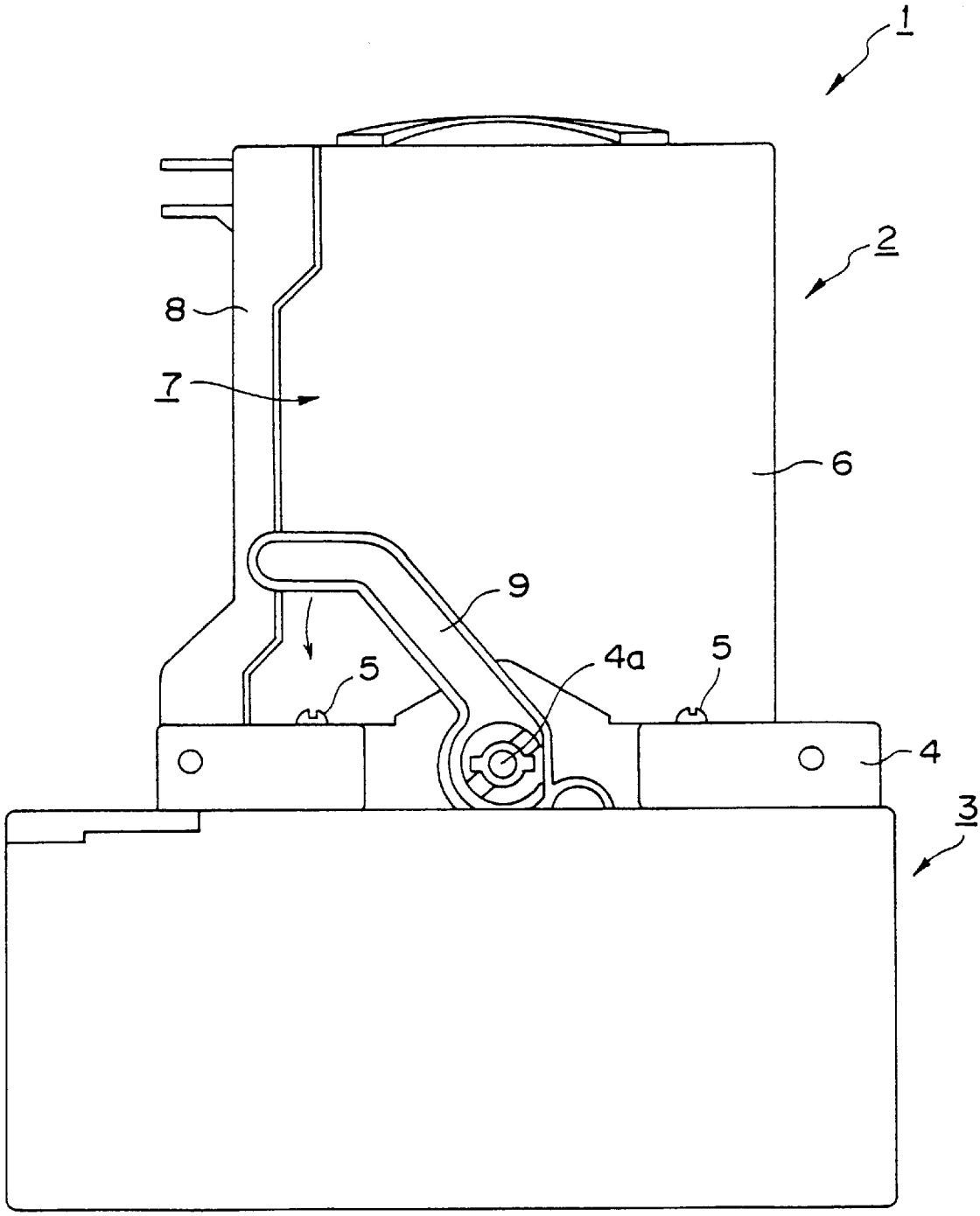
FIG. 1 is a side view of the card-dispensing device to which the present invention pertains.

FIG. 1 is a side view of the card-dispensing device to which the present invention pertains.

The card-dispensing device 1 consists essentially of a card-housing unit 2 wherein a plurality of cards is stacked and housed, and a card-dispensing unit 3 whereby the cards which are stacked and housed in the card-housing unit 2 are dispensed one by one.

The card-housing unit 2 comprises a cassette base 4 which is located and fitted on the upper surface of the card-dispensing unit 3, and a cassette box 6 which is secured to the upper surface of the cassette base 4 with the aid of screws 5 or other means of securing. A card insertion port 7 which is formed on the front surface of the cassette box 6 is covered with a cassette door 8 in such a manner that it can be opened and closed freely.

Figure 2:
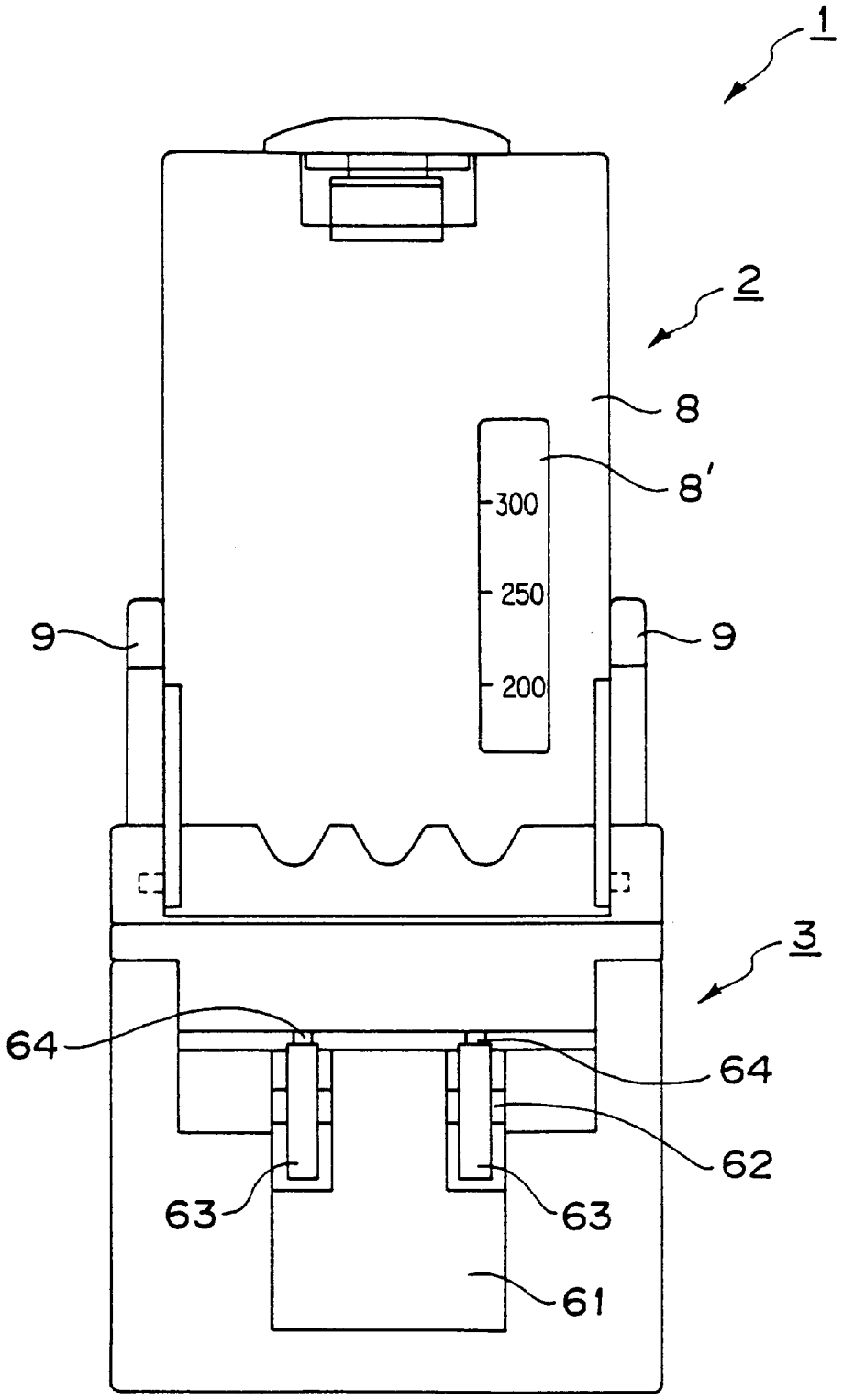
FIG. 2 is a front view of the card-dispensing device to which the present invention pertains.

As FIG. 1 and the front view of the card-dispensing device which is provided by FIG. 2 demonstrate, a pair of L-shaped latch-levers 9 is fitted on either side of the cassette base 4 in such a manner that by rotating these latch-levers 9 in a certain direction it is possible freely to attach and detach the card-housing unit 2 from the card-dispensing unit 3. In FIG. 2, 8' is a display which indicates how many cards are housed in the card-housing unit 6.

Figure 3:
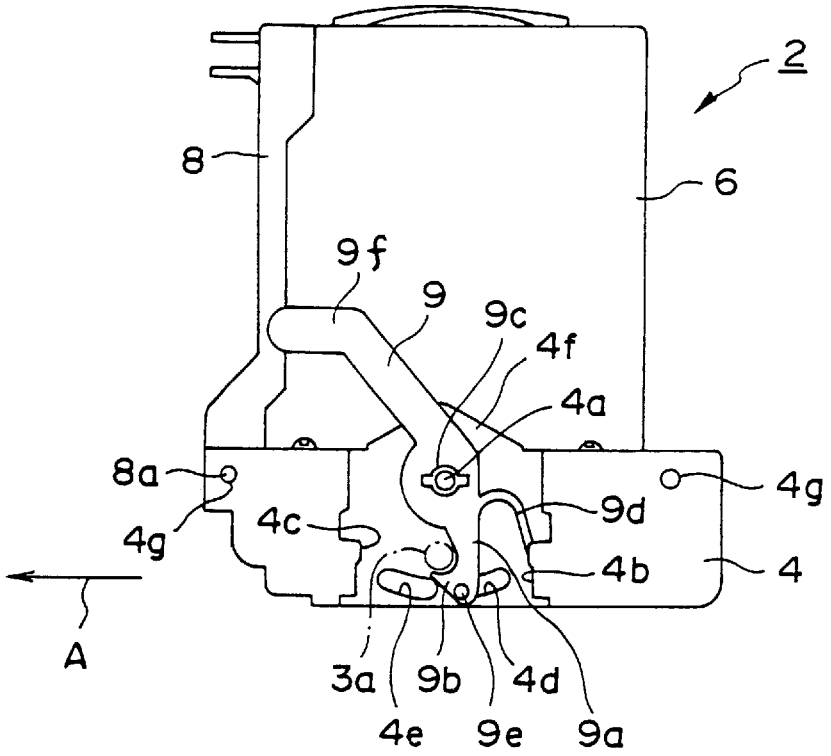
FIG. 3 is a side view of the card-housing unit.

By rotating the pair of latch-levers 9 anticlockwise around a shaft 4*a* as indicated by the arrow in FIG. 1 from the state of engagement illustrated there, it is possible to disengage the latch between the card-dispensing unit 3 and the cassette base 4, lifting the whole of the card-housing unit 2 upwards to remove it from the card-dispensing unit 3, as shown in FIG. 3.

Meanwhile, as may be seen from FIG. 3, the latch-levers 9 are supported on the shaft 4a, which protrudes at the sides of the cassette base 4, and their leading edges 9*a* are provided with claws 9*b* which engage with protrusions 3*a* formed in the interior of the card-dispensing unit 3.

In the vicinity of the bearing holes 9*c* of the latch-levers 9 where they fit on to the shaft 4*a* are spring members 9*d* formed roughly in a U-shape, the free ends of which engage with steps 4*b*. These steps 4*b* are each one of a pair 4*b*, 4*c* formed in symmetrical positions on the side of the cassette base 4. Thus, the energising force of the spring members 9*d* in a clockwise direction around the shaft 4*a* is applied constantly to the latch-levers 9.

On the obverse and reverse surfaces of the claws 9*b* which are formed on the latch-levers 9 are protrusions 9*e*, which engage with one of two arc-shaped guide grooves 4*d*, 4*e* formed in symmetrical positions left and right of the central part of the cassette base 4 on either side.

Thus, rotating the leading edges 9*f* of the latch-levers 9 (which extend in the direction of the cassette door 8) around the shaft 4*a* causes the protrusions 9*e* to move along the guide grooves 4*d*, thus preventing the latch-levers 9 from rotating beyond their prescribed angle of rotation.

Figure 4:
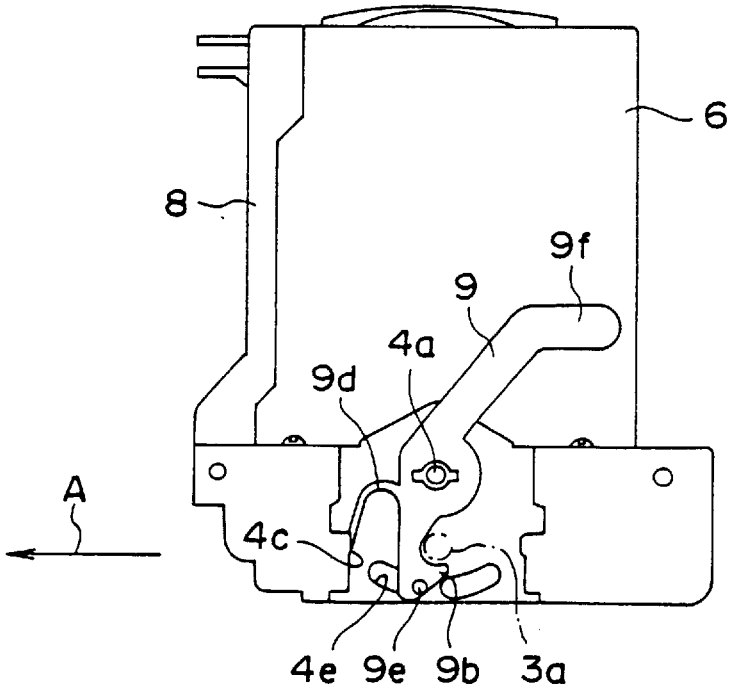
FIG. 4 is a side view of the card-housing unit.

Moreover, it is possible to detach the latch-levers 9 from the positions in which they are shown fitted in FIG. 3 and fit them back-to-front on to the shaft 4*a* as illustrated in FIG. 4. In this case, the free ends of the spring members 9*d* of the latch-levers 9 engage with the other steps 4*c* formed in the cassette base, the protrusions 9*e* engage with the other guide grooves 4*e*, and the leading edges 9*f* of the latch-levers 9 extend in the opposite direction from that of the cassette door 8, thus allowing the latch-levers 9 to be operated from the opposite direction.

In other words, the position in which the latch-levers are fitted in FIG. 3 is such that they can be operated from the side where the cassette door 8 is, while the position illustrated in FIG. 4 allows them to be operated from the opposite side.

It sometimes happens that the whole card-housing unit 2 is removed from the card-dispensing unit 3 (FIG. 1) when the cassette box 6 is replenished with cards. At such times, if the latch-levers 9 are fitted in the manner shown in FIG. 3, the operator can easily detach the card-housing unit 2 from the card-dispensing unit 3 by operating the latch-levers from the side where the cassette door 8 is situated and where the cards are dispensed (indicated by the arrow A). If on the other hand the latch-levers 9 are fitted in the manner shown in FIG. 4, the operator can easily detach the card-housing unit 2 from the card-dispensing unit 3 by operating the latch-levers from the side opposite to that where the cassette door 8 is situated (indicated by the arrow A).

Meanwhile, as FIG. 3 shows, the position of the cassette box 6 is determined so as to centre on a protrusion 4*f*, which is formed in the shape of an isosceles triangle on the upper surface of the central section of the cassette base 4. Bearing holes 4*g* which support shafts 8*a* protruding below the cassette door 8 are also formed in pairs in symmetrical positions right and left of the central protrusion 4*f*. These also allow the cassette box 6 to be fitted back-to-front in relation to the cassette base 4.

Figure 5:
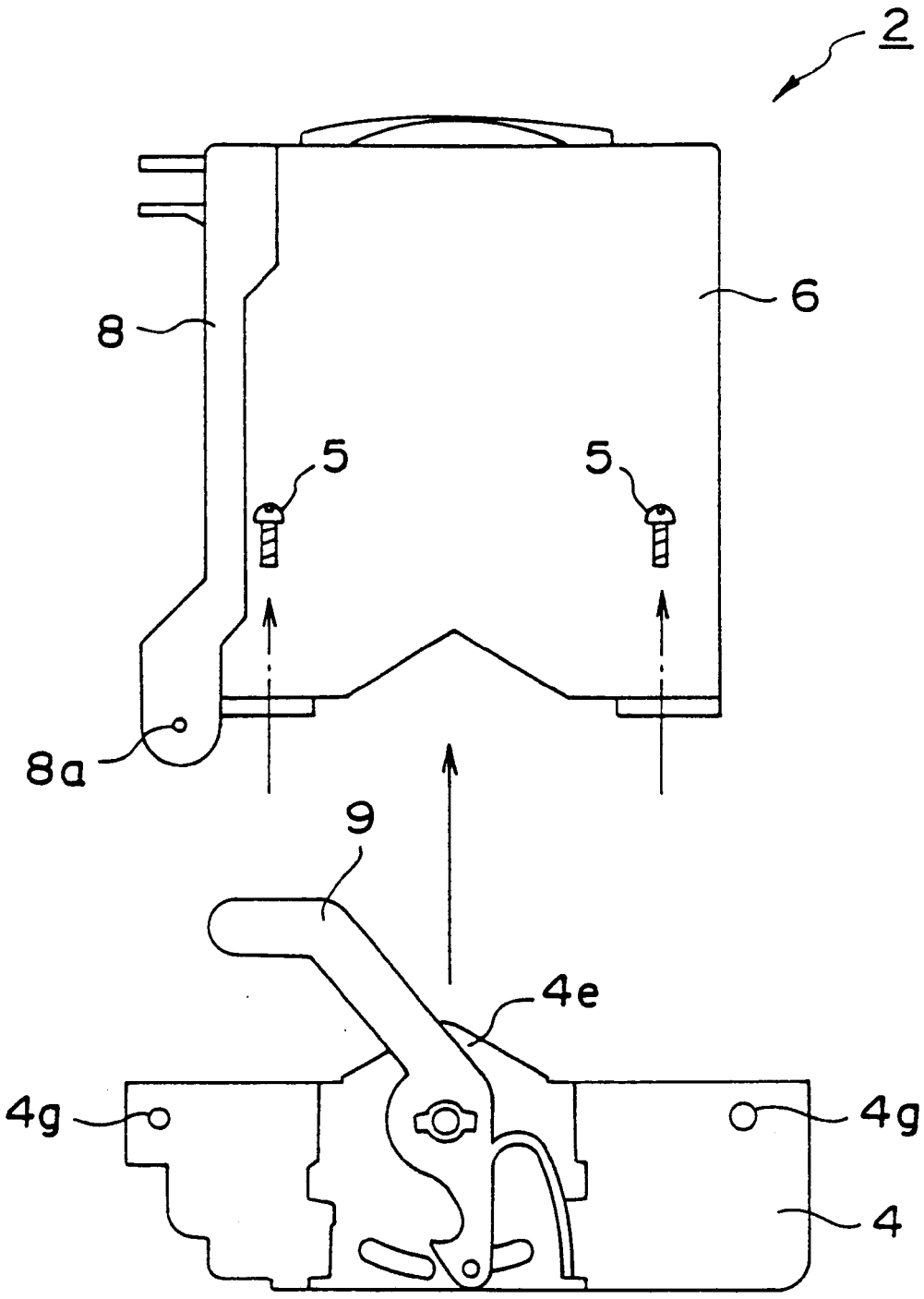
FIG. 5 is an exploded side view of the card-housing unit.
Figure 6:
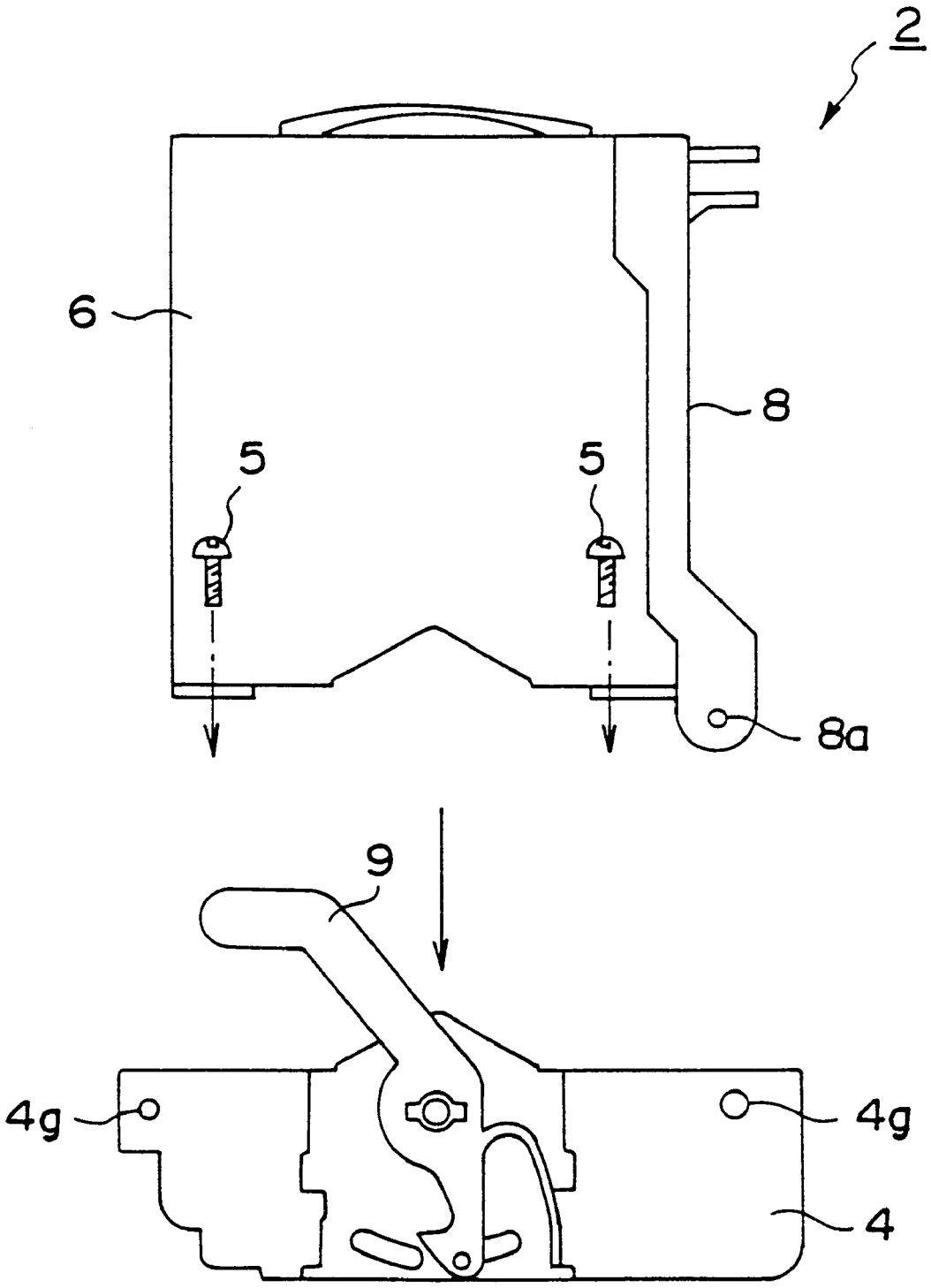
FIG. 6 is an exploded side view of the card-housing unit.
Figure 7:
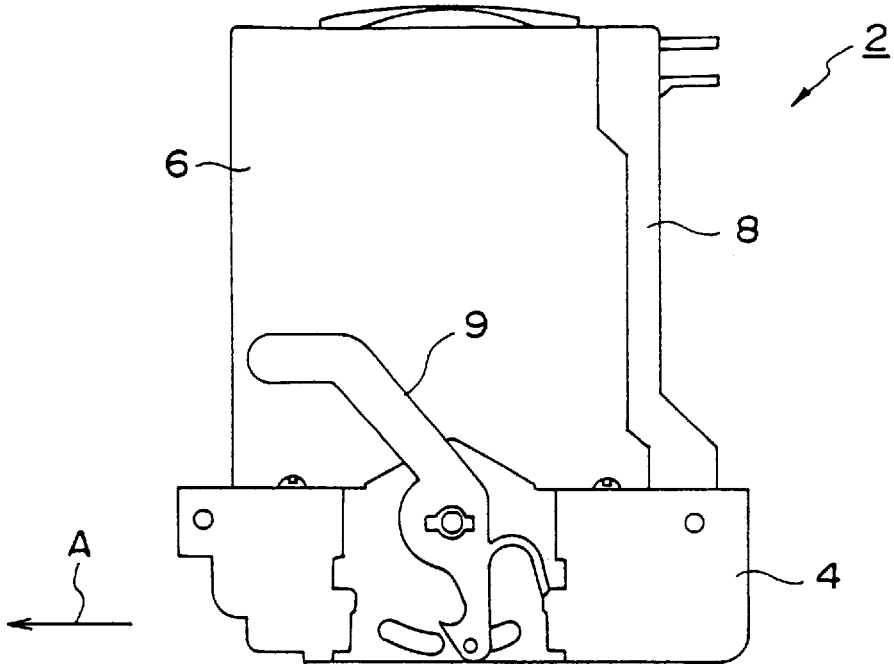
FIG. 7 is a side view of the card-housing unit.

In other words, by disengaging the screws 5 as shown in FIG. 5 from the cassette box 6 fitted in the position illustrated in FIG. 3, removing the cassette box 6 and cassette door 8 from the cassette base 4, then reversing the cassette box 6 and cassette door 8 as shown in FIG. 6 and fixing them back on to the cassette base 4, it is possible to fit the cassette door 8 so that it faces in the opposite direction from at in which the cards are dispensed, as indicated by the arrow A in FIG. 7.

In the mode of fitting the cassette box 6, cassette door 8 and latch-levers 9 which is illustrated in FIG. 7, it is easy to open the cassette door 8 and replenish the cassette box 6 with cards from the opposite direction (denoted by the arrow A) to the one in which the cards are dispensed, and it is also a simple task to release the card-housing unit 2 by operating the latch-levers 9 in the opposite direction (denoted by the arrow A) to the one in which the cards are dispensed.

Figure 8:
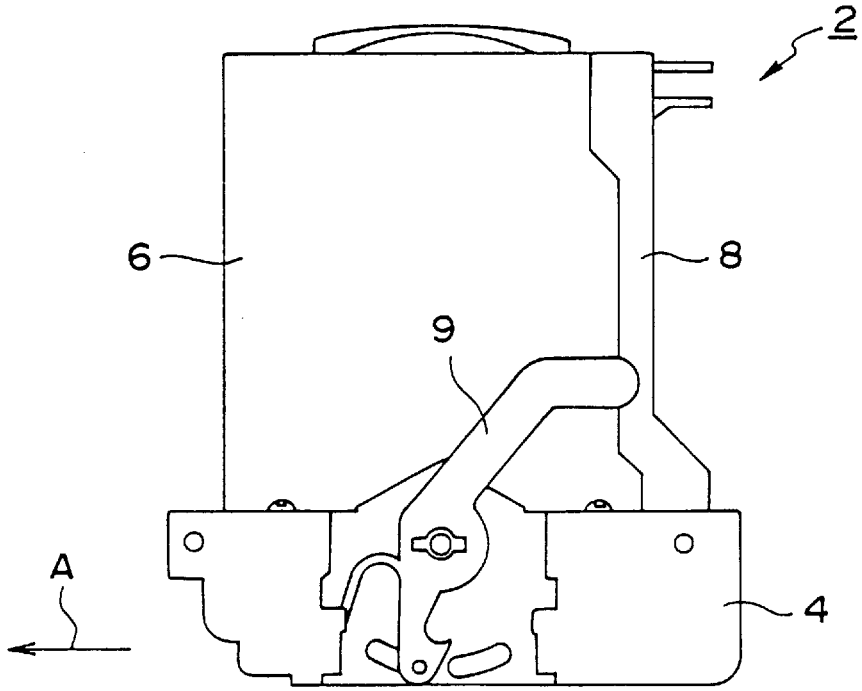
FIG. 8 is a side view of the card-housing unit.

Moreover, if the position in which the latch-levers 9 are fitted in FIG. 7 is reversed as in FIG. 8, it is also easy to open the cassette door 8 and replenish the cassette box 6 with cards from the opposite direction (denoted by the arrow A) to the one in which the cards are dispensed, and it is a simple task to release the card-housing unit 2 by operating the latch-levers 9 in the opposite direction (denoted by the arrow A) to the one in which the cards are dispensed.

There now follows a detailed description of the internal structure of the card-housing unit 2.

Figure 9:
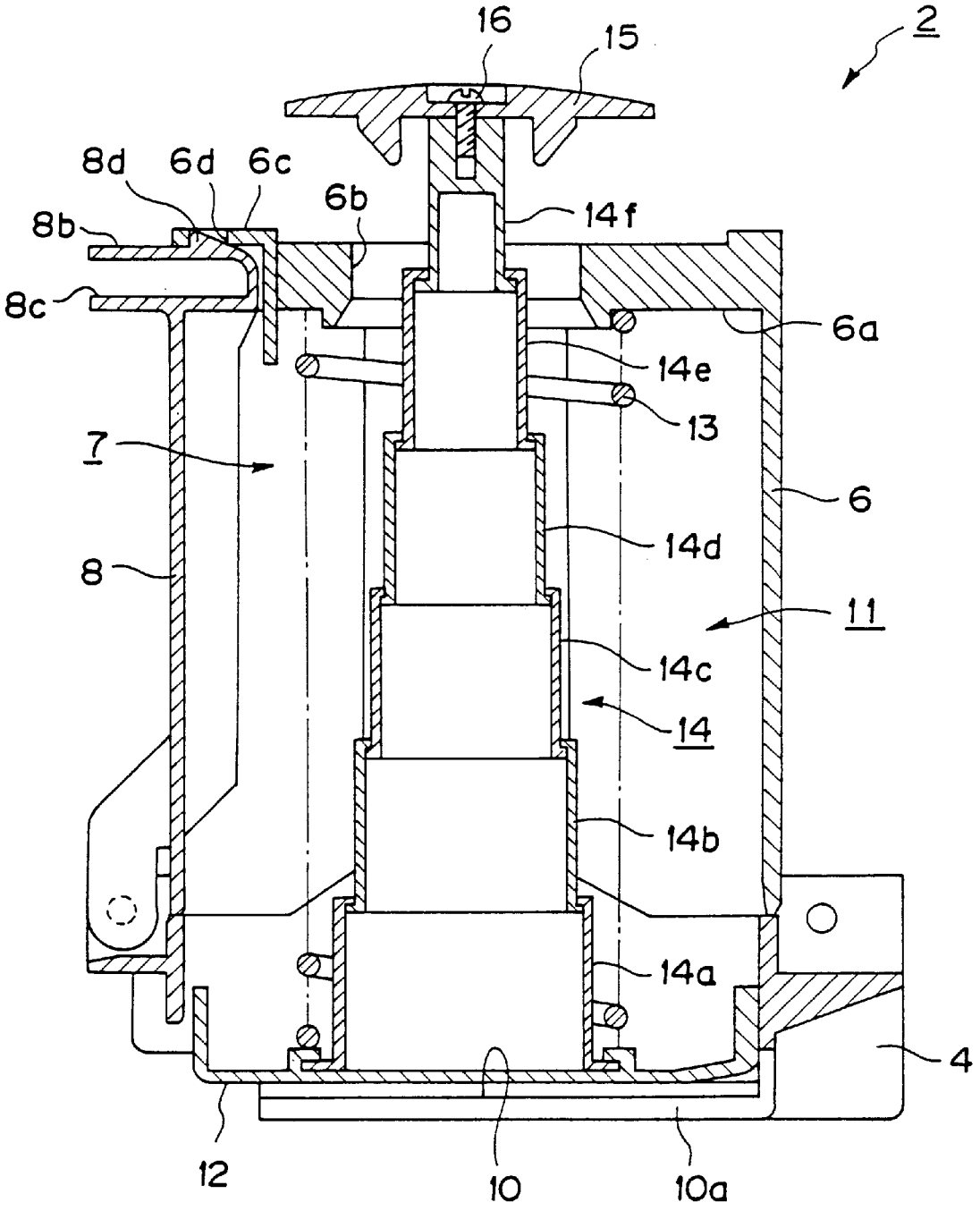
FIG. 9 is an enlarged cross-sectional view of the card-housing unit.

FIG. 9 is an enlarged cross-sectional view of the card-housing unit, in which those parts which are common to FIG. 3 have been allocated the same codes.

As has already been explained, the card-housing unit 2 comprises a cassette base 4 which is located and fitted on the upper surface of the card-dispensing unit 3 (FIG. 1), a cassette box 6 which is secured to the upper surface of the cassette base 4, and a cassette door 8 which allows the card insertion port 7 of the cassette box 6 to be opened and closed. Within the cassette base 4 and the cassette box 6 is located depressing means 11 whereby the plurality of cards (not illustrated in the drawings) with which they are filled are pressed down in the direction of the bottom 10 of the cassette base 4. On the bottom 10 of the cassette base 4 is formed a groove 10*a* along which runs a slide as described below backwards and forwards in the direction in which the cards are dispensed.

The depressing means 11 comprises a base-plate 12 with a U-shaped cross-section, and a coil spring 13 which is located between the base-plate 12 and the ceiling 6*a* of the cassette box 6 in such a manner that the energising force of the coil spring 13 constantly energises the base-plate 12 in a downwards direction (towards the bottom 10 of the cassette base).

On the upper surface of the- base-plate 12 is located the base-plate lifting means 14, whereby the base-plate 12 is forcibly lifted when the cards are replenished, thus facilitating the operation of replenishing the cards by expanding the whole of the card insertion port 7.

The base-plate lifting means 14 comprises a plurality of (six) cylindrical bodies 14*a*, 14*b*, 14*c*, 14*d*, 14*e*, 14*f* of mutually differing internal diameters, of which the upper edges only engage with one another. A cap 15 is attached to the uppermost cylindrical body 14*f* by means of a screw 16, while the lowermost cylindrical body 14*a* is fixed to the base-plate. The diameter of the cap 15 is greater than that of an aperture 6*b* which is formed in the ceiling 6*a* of the cassette box 6 and into which the cylindrical bodies fit. As a result of this there is no risk of the cap 15 falling through the aperture 6*b* into the cassette box 6.

The plurality of cylindrical bodies 14*a*, 14*b*, 14*c*, 14*d*, 14*e*, 14*f* is arranged in such a manner that their diameters decrease successively from that of the lowermost cylindrical body 14*a* to that of the uppermost cylindrical body 14*f*.

Between the periphery of the lowermost cylindrical body 14*a*, which has the greatest diameter, and the periphery of the aperture 6*b* which is formed ceiling 6*a* of the cassette box 6 is located the engaging means (not illustrated in the drawings), whereby the two engage with each other.

Figure 10:
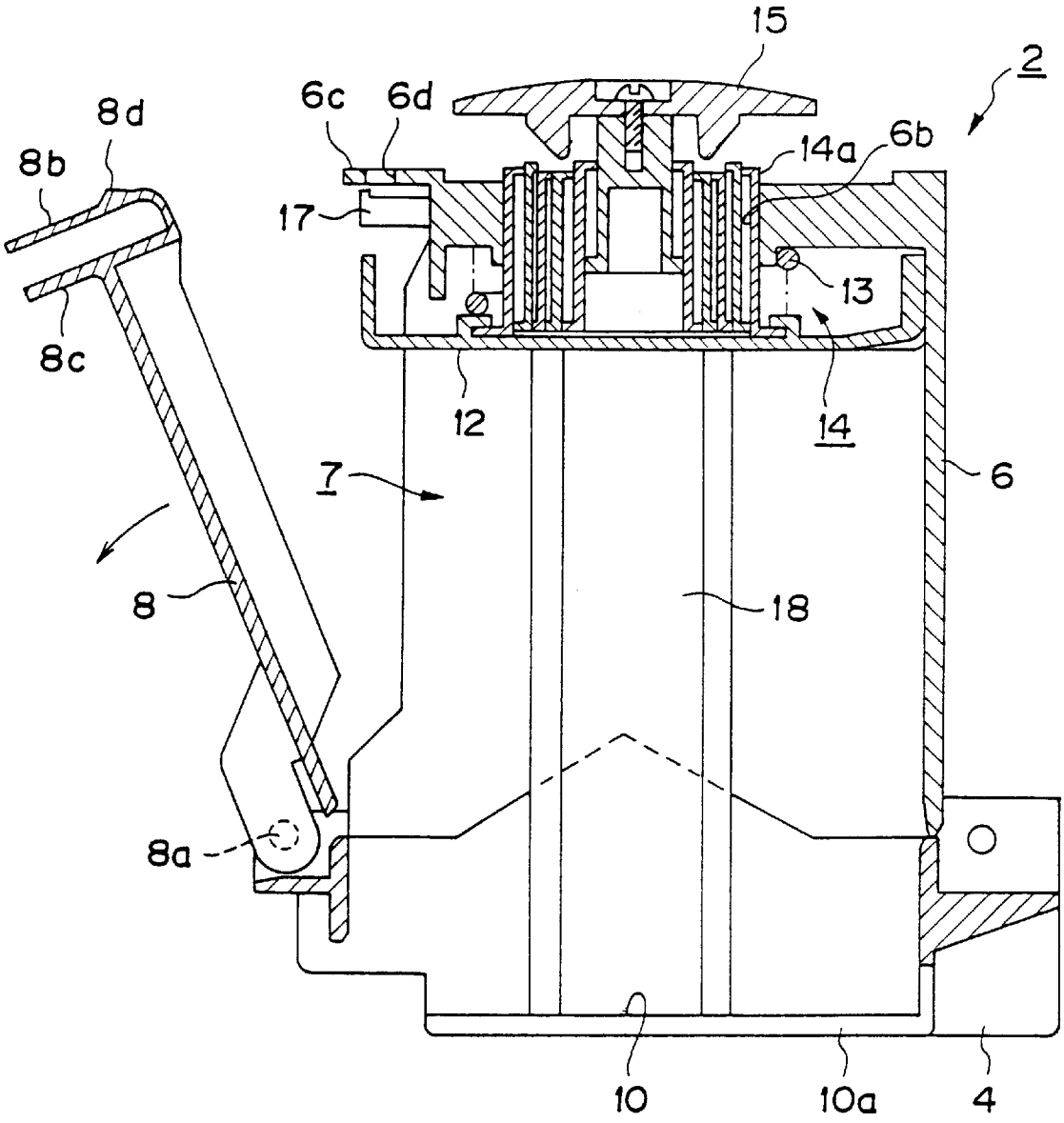
FIG. 10 is an enlarged cross-sectional view of the card-housing unit.

Squeezing a pair of lips 8*b*, 8*c* which are formed at the top of the cassette door 8 causes a protrusion 8*d* which is formed on the lip 8*b* to disengage from a hole 6*d* which is formed in a lip 6*c* of the cassette box 6, allowing the cassette door 8 to open. If the cap 15 is then raised in such a manner as to resist the energising force of the coil spring 13 and lift the base-plate 12 upwards, the engaging means (not illustrated in the drawings) which is present between the periphery of the cylindrical body 14*a* and the periphery of the aperture 6*b* engages and holds the cylindrical body 14*a* in position within the aperture 6*b*, thus allowing the whole of the card insertion port to open for the purpose of replenishing cards. In FIG. 10, code 17 is a lever which protrudes below the lip 6*c* of the cassette box 6 for the purpose of disengaging the engaging means, while code 18 is a pair of box plates with trapezoid cross-sections which are placed on the inner peripheral surface of the cassette box 6 in the lateral direction.

In other words, these box plates 18 may be removed when replenishing the cassette box 6 with large cards, or fitted as in this embodiment when the cards are of a smaller size.

As may be seen from FIG. 10, once the cylindrical body 14*a* has engaged with the engaging means (not illustrated in the drawings) and come to a halt, the cap 15 is released and the cylindrical bodies 14*b*, 14*c*, 14*d*, 14*e*, 14*f* (ie all those apart from 14*a*) fall down within the cylindrical body 14*a* and are contained there.

In this manner, the above embodiment further simplifies the task of removing the card-housing unit 2 from an automatic vending machine and replacing it when replenishing the cassette box with cards because the base-plate lifting means 14 does not protrude above the cassette box 6, and the size of the cassette box 6 in the longitudinal direction does not vary.

Figure 11:
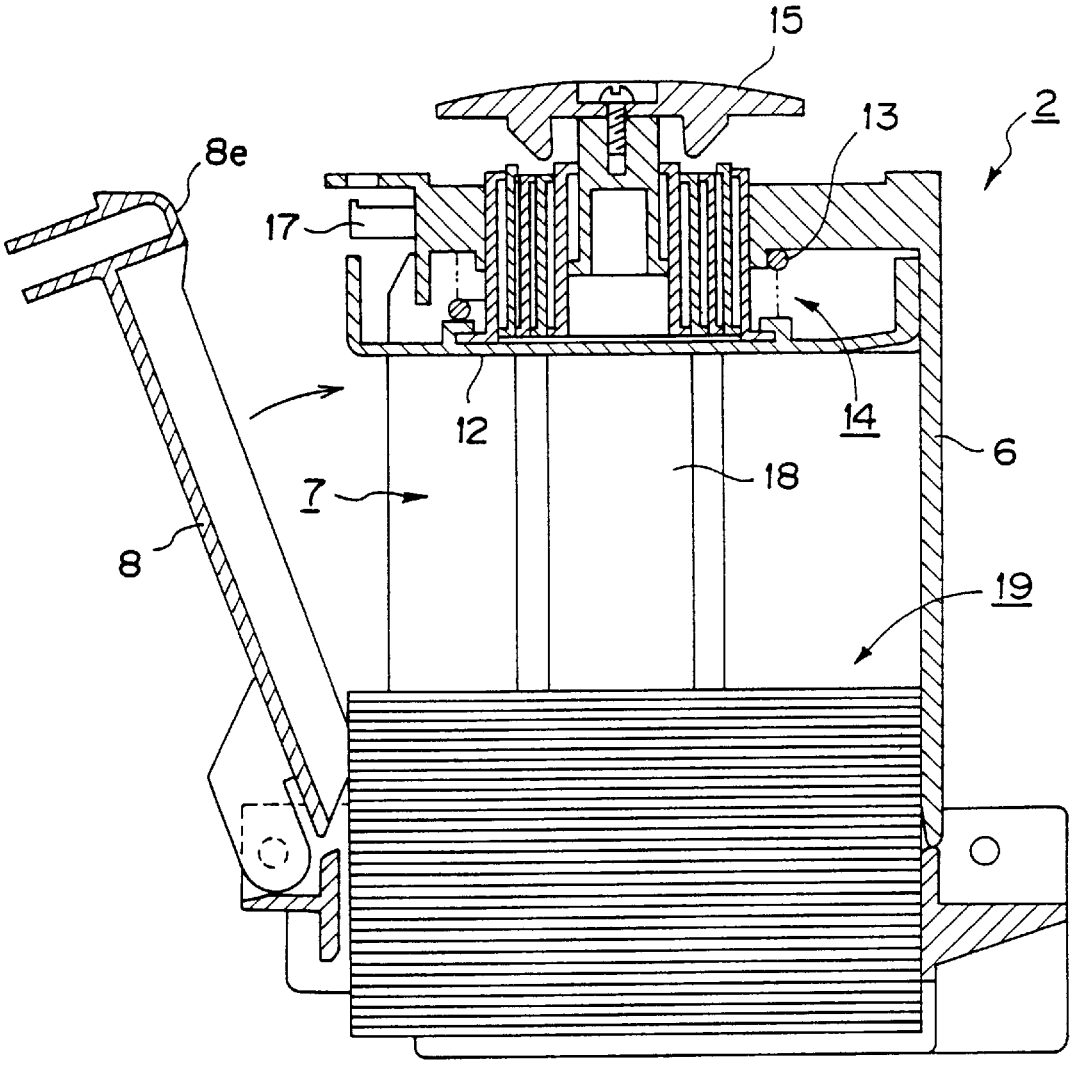
FIG. 11 is an enlarged cross-sectional view of the card-housing unit.
Figure 12:
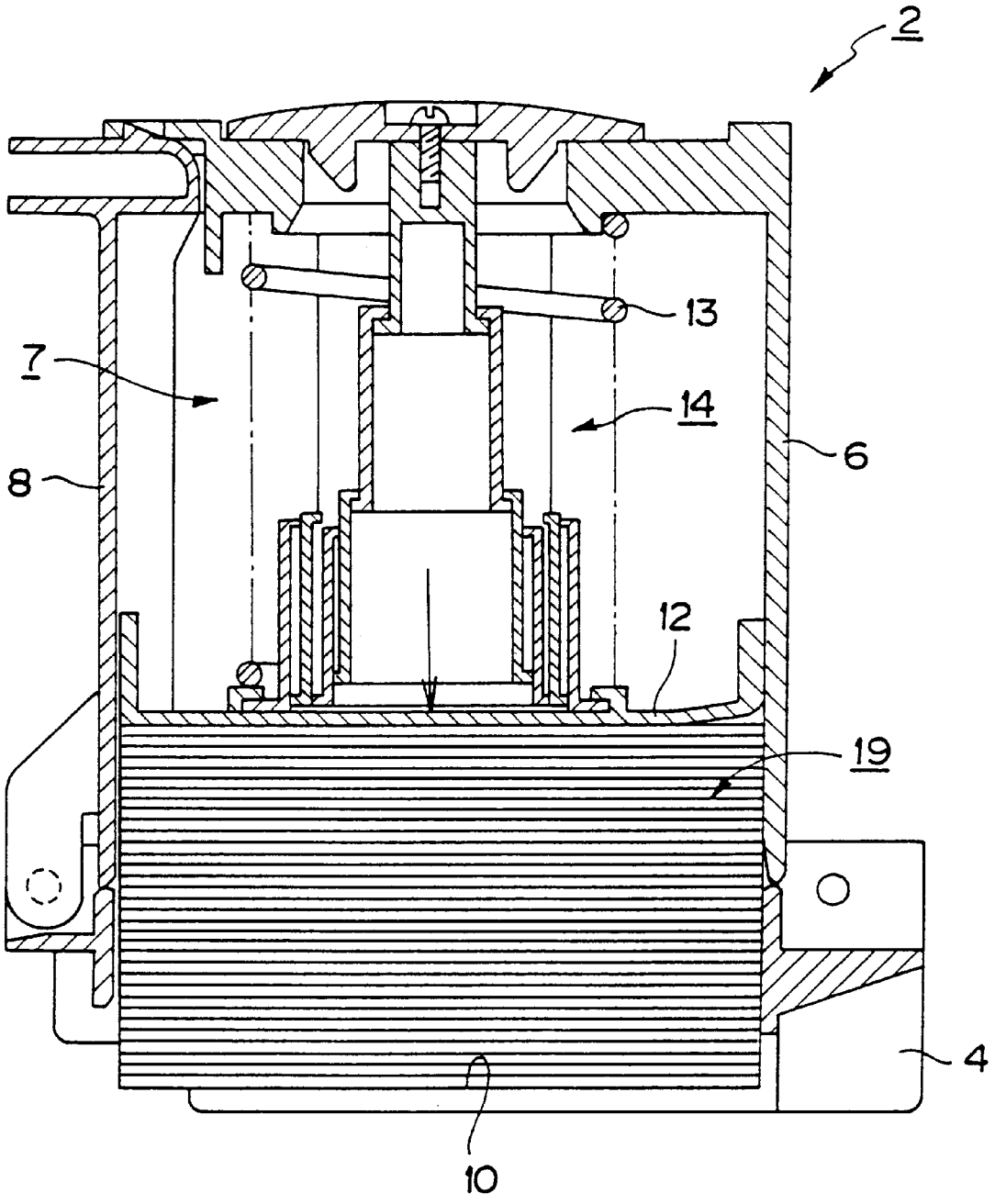
FIG. 12 is an enlarged cross-sectional view of the card-housing unit.

Next, the cassette door 8 is opened even wider than is shown in FIG. 10 so as to release the card insertion port 7 to its maximum extent. The cassette box 6 is then filled through the card insertion port 7 with a plurality of cards 19, as FIG. 11 shows, after which the cassette door 8 is employed to close the card insertion port 7. At this point the leading edge 8*e* of the cassette door 8 and the lever 17 for the purpose of disengaging the engaging means collide, pushing the lever 17 in and thus disengaging the engaging means. Thus, as may be seen from FIG. 12, the base-plate 12 moves downwards as a result of the energising force of the coil spring 13 which constitutes the base-plate lifting means 14, pushing the plurality of cards 19 down from above and pressing them in the direction of the bottom 10 of the cassette base.

There now follows a detailed description of the card-dispensing unit 3.

Figure 13:
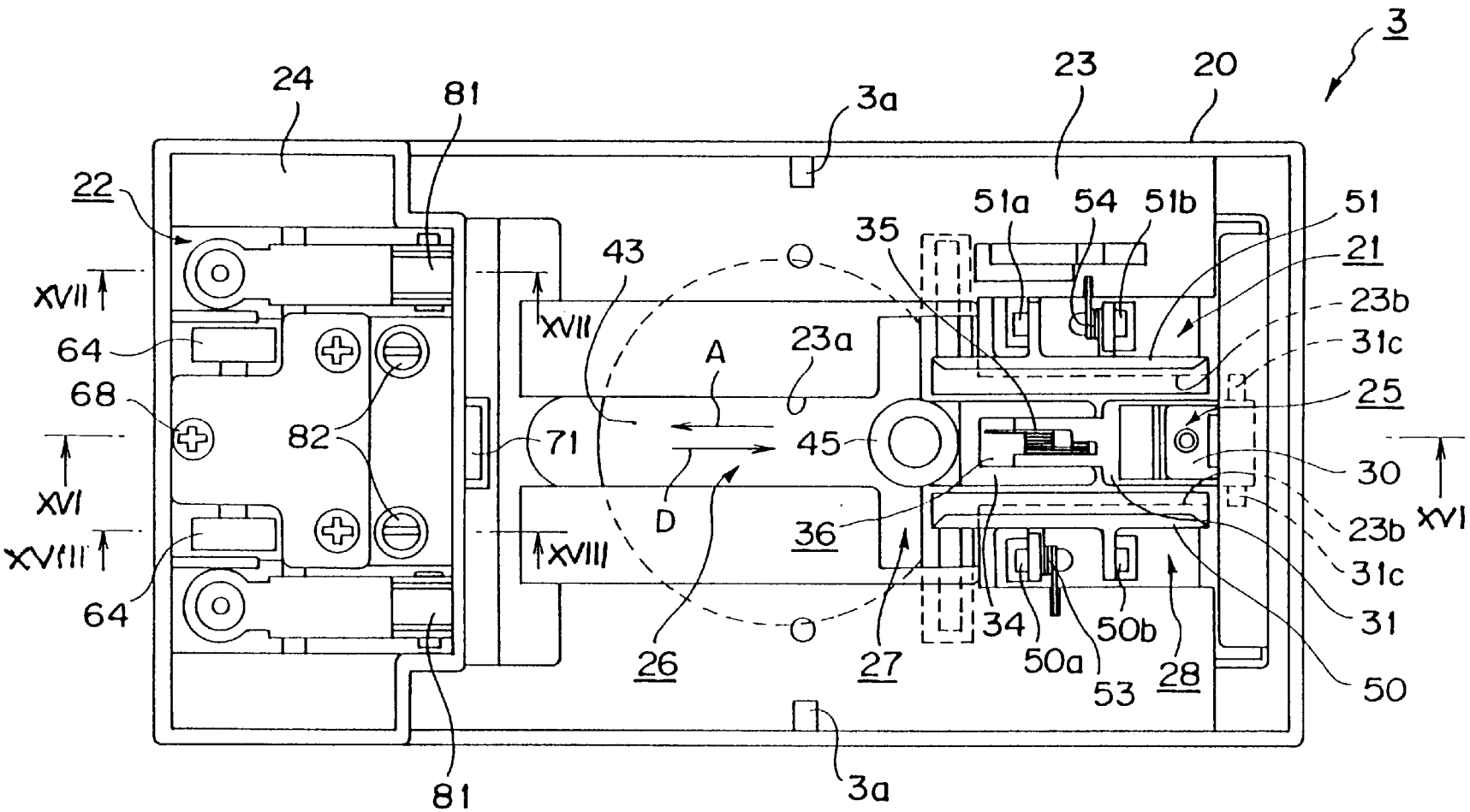
FIG. 13 is a top view of the card-dispensing unit.

FIG. 13 is a top view of the card-dispensing unit 3 without the card-housing unit 2.

The card-dispensing unit 3 is housed within a flat rectangular casing 20, and comprises card separating and feeding means 21, and card ejecting means 22 whereby the cards, which are fed one by one by the card separating and feeding means 21, are ejected.

The card separating and feeding means 21 is located beneath a centre base 23 which covers the upper surface of the casing 20, while the card ejecting means 22 is located beneath an exit bracket 24 which covers the leading edge side of the casing 20.

The card separating and feeding means 21 engages with the bottommost card from among the plurality of cards 19 (FIG. 12) which are housed within the card-housing unit 2, separating and feeding them one by one. It comprises a slide which engages with the card, slide driving means 26 which allows the slide 25 to move backwards and forwards in a left-right direction on the drawing, slide guiding means 27 which guides the slide 25 right and left in the drawing and slide attitude modifying means 28 whereby the attitude of the slide 25 is modified during its forward and backward run.

Figure 14:
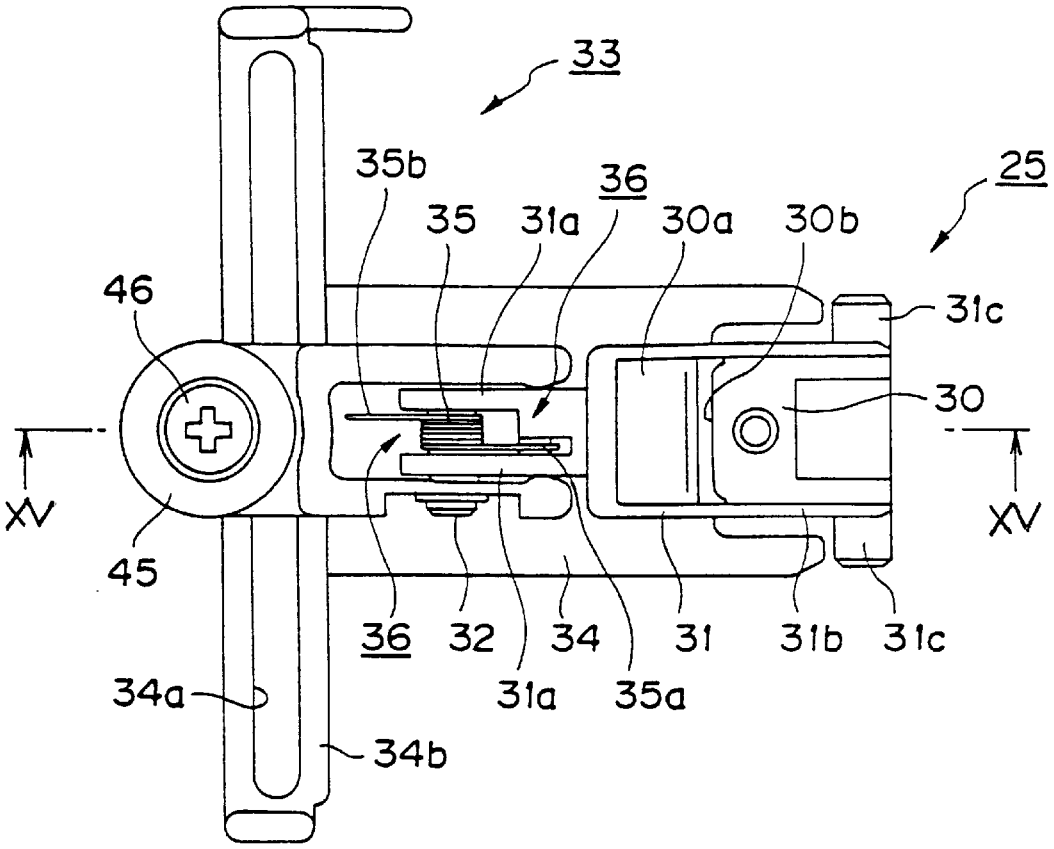
FIG. 14 is an enlarged top view of the slide.
Figure 15:
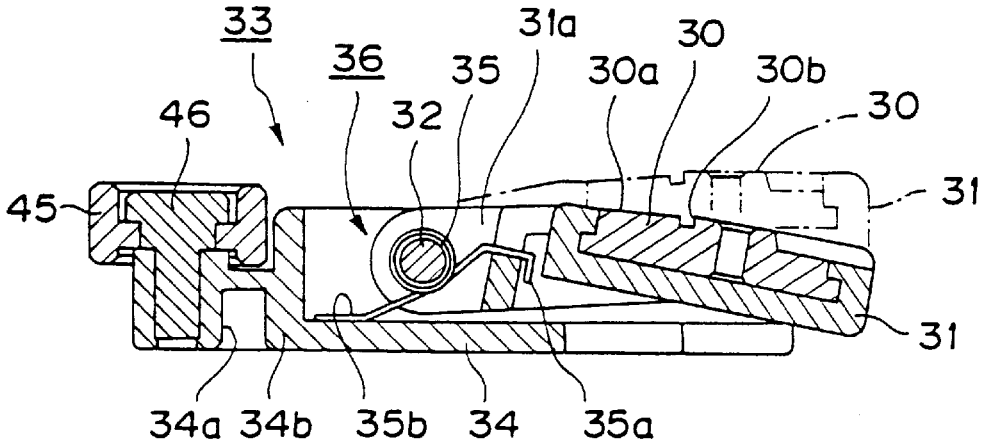
FIG. 15 is a cross-section along the line XV—XV of FIG. 14.

As the enlarged top view of FIG. 14 demonstrates, the slide 25 comprises a main slide body 30 formed of a sintered metal member, and a slide holder 31 which contains the main slide body 30. FIG. 15 is a cross-section along the line XV—XV of FIG. 14. As may be seen from FIG. 15, the leading edge 31*a* of the slide holder 31 is supported with the aid of a shaft 32 by a reciprocating slider 34 in such a manner as to be capable of rotating freely. The reciprocating slider 34 forms part of a reciprocating slider link mechanism 33, and this in turn constitutes part of the slide driving means 26, which will be described later. On the upper surface 30*a* of the main slide body 30 is formed a step section 30*b* having a difference in height which is somewhat less than the thickness of the card which is to be separated and fed.

Meanwhile, around the shaft 32, which supports the slide holder 31 in such a manner as to be capable of rotating freely, is wound the energising means 36 comprising a coil spring 35 which forms part of the undermentioned slide attitude modifying means 28. One end 35*a* of the spring coil 35 engages with the slide holder 31, while the other end 35*b* engages with the reciprocating slider 34.

Consequently, as FIG. 15 demonstrates, the energising means 36 has the effect of constantly energising the slide holder 31 by virtue of the energising force of the coil spring 35 from the horizontal attitude denoted by the one-dot chain line to the inclined attitude denoted by the unbroken line.

Code 31*c* in FIG. 14 denotes a pair of guide protrusions formed on either side of the trailing edge 31*b* of the slide holder 31 and forming part of the undermentioned slide attitude modifying means 28. These guide protrusions 31*c* engage with part of the undermentioned slide attitude modifying means 28, and serve to modify the attitude of the slide holder 31 from a horizontal one wherein it is parallel with the card which is to be dispensed, as denoted by the one-dot chain line in FIG. 15, to an inclined one wherein it is separated from the card, as denoted by the unbroken line in FIG. 15.

There now follows a detailed description of the slide driving means 26.

Figure 16:
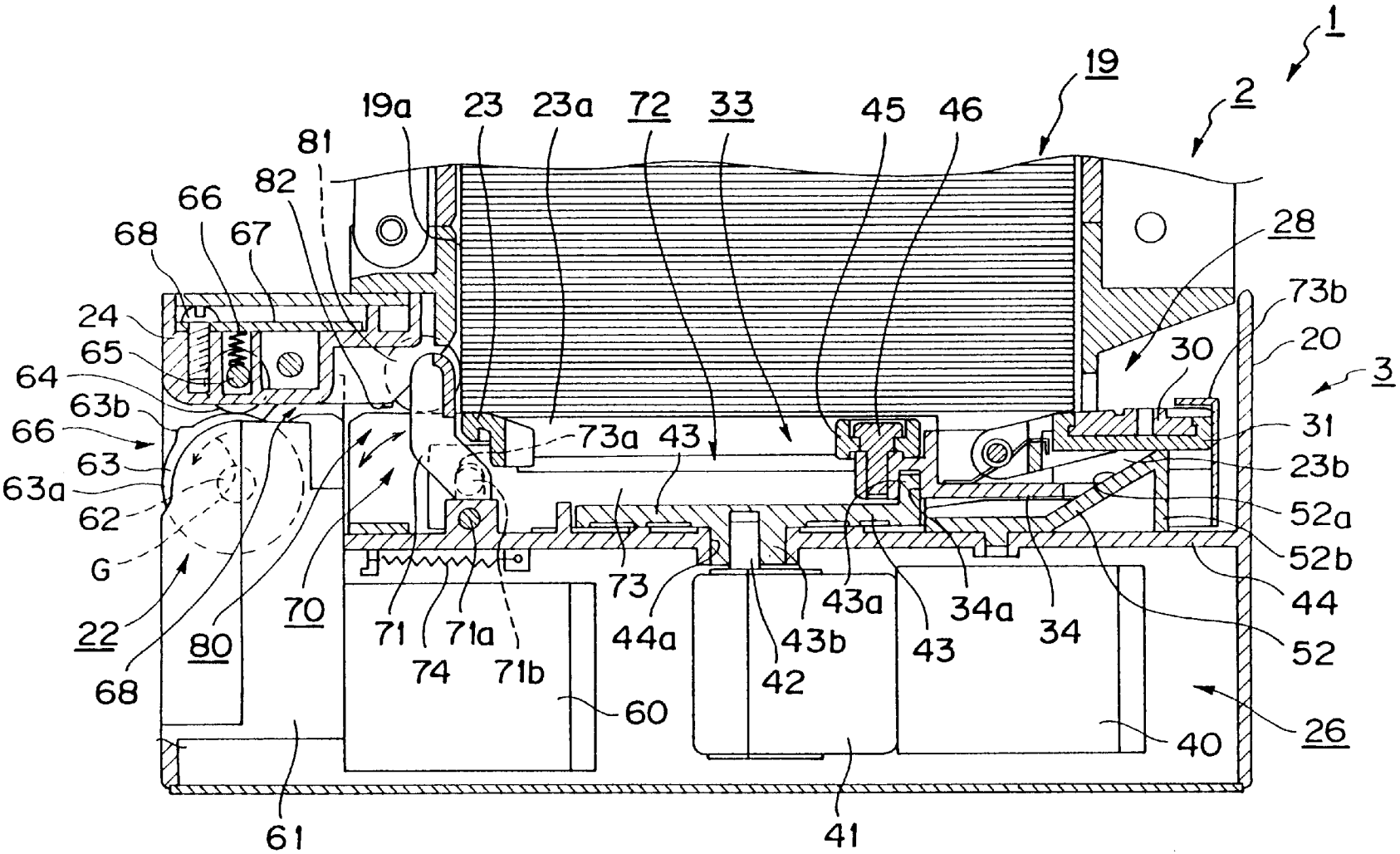
FIG. 16 is a cross-section along the line XVI—XVI of FIG. 13.

FIG. 16 is a cross-section along the line XVI—XVI of FIG. 13. As may be seen from FIG. 16, the slide driving means 26 comprises a first drive motor 40, a gear transmission mechanism 41 whereby the rotation of the drive motor 40 is decelerated and relayed, and a reciprocating slider link mechanism 33 whereby the turning force which is relayed from the output shaft 42 of the gear transmission mechanism 41 is converted into reciprocating movement of the main slide body 30 in a left-right direction.

The reciprocating slider link mechanism 33 comprises a circular disc 43 which rotates by virtue of the turning force which is relayed from the output shaft 42 of the gear transmission mechanism 41, a protrusion 43*a* which is formed on the outer periphery of the upper surface of the circular disc 43, and the reciprocating slider 34 having a guide groove 34*a* which engages with the protrusion 43*a*.

The circular disk 43 is rotatably supported on a partition 44 which divides the interior of the casing 20 into upper and lower rooms, by way of a shaft 43*b* formed at the centre of the circular disk 43, which shaft 43*b* is fitted into a bearing hole 44*a* formed in the partition 44. The guide groove 34*a* is formed in a guide bar 34*b* which is integrally formed with the reciprocating slider 34 as shown in FIG. 14.

Between the guide groove 34*a* and the casing 20 is located a first detection means (not illustrated in the drawings) which detects whether or not the reciprocating slider 34 is in the initial position illustrated in FIG. 16. If the reciprocating slider 34 is in the initial position illustrated in FIG. 16, the first detection means transmits an OFF signal to a control device (not illustrated in the drawings); if it moves from the initial position illustrated in FIG. 16, it transmits an ON signal to the control device.

Thus, with the aid of the reciprocating slider link mechanism 33, the circular disc 43 rotates once and the protrusion 43*a* completes one return journey along the guide groove 34*a*. Meanwhile the reciprocating slider 34 executes a return journey, moving from its initial position as illustrated in FIG. 16 to the left (outwards), then to the right (inwards) to return to its initial position as illustrated in FIG. 16.

There now follows a detailed description of the slide guiding means 27, which guides the slide 25 right and left in the drawing with the aid of the reciprocating slider 34 of the driving means 26.

As FIG. 13 shows, the slide guiding means 27 comprises a roller guide groove 23*a* which is formed in the centre of the centre base 23 in a left-right direction in the drawings, a guide roller 45 which is inserted into the roller guide groove 23*a* and guided, and a slider guide groove 23*b* which guides the reciprocating slider illustrated in FIG. 16 in a left-right direction in the drawings. Of these, the roller guide groove 23*a* and slider guide groove 23*b* are both formed in the centre base 23, while the guide roller 45 is fitted with the aid of a screw 46 to the flat rectangular reciprocating slider 34 in such a manner as to be capable of rotating freely, as is illustrated in FIGS. 14 and 15.

Thus, with the aid of the guiding means 27, when the reciprocating slider 34 of the driving means 26 moves in a left-right direction in the drawings from its initial position as depicted in FIG. 13, the reciprocating slider 34 is first guided along the slider guide groove 23*b*, and then along the roller guide groove 23*a* into which the guide roller 45 is inserted.

Consequently, the slide 25 which is mounted on the reciprocating slider 34 also runs smoothly backwards and forwards in a left-right direction in FIG. 13 along the slider guide groove 23*b* and roller guide groove 23*a*.

Next there follows a detailed description of the slide attitude modifying means 28, which serves to modify the attitude of the main slide body 30 while the slide 25 is running backwards and forwards.

As will be seen from FIG. 13, the slide attitude modifying means 28 comprises the energising means 36 consisting of a coil spring 35 as already mentioned, a pair of guides for changing the attitude of the slide 50, 51 which are located facing each other on either side of the reciprocating slider 34, a guide protrusion 31*c* formed on the trailing edge of the slide holder 31 which engages with and is guided by these guides for changing the attitude of the slide 50, 51 as illustrated in FIG. 14, and an inclined wall 52 which is fixed to the partition 44 which divides the interior of the casing 20 into upper and lower rooms and comes into contact with the lower surface of the slide holder 31 as illustrated in FIG. 16.

As FIG. 13 shows, the pair of guides for changing the attitude of the slide 50, 51 is each formed by a guide rail with a roughly L-shapes cross-section. Of these, the guide for changing the attitude of the slide 50 is supported in such a manner as to be able to rotate around a pair of shafts 50*a*, 50*b* which are formed in a position which is parallel with the direction in which the reciprocating slider 34 proceeds. Meanwhile, the other guide for changing the attitude of the slide 51 is also supported in such a manner as to be able to rotate around a pair of shafts 51*a*, 51*b* which are formed in a position which is parallel with the direction in which the reciprocating slider 34 proceeds.

To one of the shafts 50*a*, 51*b* of each of the guides for changing the attitude of the slide 50, 51 is fitted a return spring 53, 54. Of these, one of the free ends of the return spring 53 engages with the centre base 23, while the other engages with the guide for changing the attitude of the slide 50. Similarly, one of the free ends of the other return spring 54 engages with the centre base 23, while the other engages with the guide for changing the attitude of the slide 51.

Consequently, of the abovementioned pair of guides for changing the attitude of the slide 50, 51 one (50) is constantly subject to an energising force exerted by the return spring 53 to rotate in a clockwise direction around the pair of shafts 50*a*, 50*b*, while the other (51) is constantly subject to an energising force exerted by the return spring 54 to rotate in an anticlockwise direction around the pair of shafts 51*a*, 51*b*.

Meanwhile, as FIG. 16 shows, there is formed on the inclined wall 52, which is fixed to the partition 44 as illustrated in FIG. 16, an inclined surface 52*a* with the right side elevated in such a manner as to raise the main slide body 30, when it moves to the right in the drawings so that the reciprocating slider may retain its original position as illustrated in FIG. 16, from the inclined attitude indicated in FIG. 15 by the unbroken lines to a position wherein it is parallel with the surface of the cards (indicated by broken lines).

Thus, with the aid of the energising means 36 consisting of the coil spring 35 which constitutes the slide attitude modifying means 28, the pair of guides for changing the attitude of the slide 50, 51, the guide protrusion 31*c* and the inclined wall 52, when the reciprocating slider 34 commences its outward run in which it moves from its initial position towards the left of the drawing as indicated by the arrow A in FIG. 13, the guide protrusion 31*c* of the slide holder 31 which is supported by the reciprocating slider 34 is guided on the pair of guides for changing the attitude of the slide 50, 51, as a result of which the slide holder 31 and the main slide body 30 move towards the left-hand side of FIG. 13 (in the outward direction indicated by the arrow A) while maintaining an attitude which is parallel with the cards, namely the attitude indicated by the one-dot chain lines in FIG. 15.

When the guide protrusion 31*c* of the slide holder 31 leaves the left end of the pair of guides for changing the attitude of the slide 50, 51, the slide holder 31 swiftly rotates in a clockwise direction around the shaft 32 as a result of the energising force of the coil spring 32 as indicated by the unbroken lines in FIG. 15. At the same time the main slide body 30 assumes an inclined position wherein it is separated from the cards as is indicated by the unbroken lines.

Meanwhile, it has already been mentioned that when the reciprocating slider 34 commences its inward run in which it moves towards the right of the drawing as indicated by the arrow D in FIG. 13, the slide holder 31 is in the position indicated by the unbroken lines in FIG. 15. As a result, its guide protrusion 31c and the pair of guides for changing the attitude of the slide 50, 51 do not engage because they are not in a horizontal positional relationship with one another. Instead, the slide holder 31 passes underneath the pair of guides for changing the attitude of the slide 50, 51, maintaining its inclined attitude. When its trailing edge reaches the beginning of the inclined wall 52 illustrated in FIG. 16, the inclined surface 52*a* causes the slide holder 31 to resist the energising force of the coil spring 35 illustrated in FIG. 15 and modify its attitude by gradually rotating in an anticlockwise direction around the shaft 32. Finally, when the reciprocating slider 34 regains its initial position as shown in FIG. 16, the slide holder 31 also regains its initial position wherein it is parallel with the cards.

In other words, the slide attitude modifying means 28 repeatedly modifies the attitude of the slide holder 31 and the main slide body 30 each time the reciprocating slider 34 executes a return movement left and right.

There follows a detailed description of the card ejecting means 22.

As may be seen from FIG. 16, the card ejecting means 22 comprises a second drive motor 60, a gear transmission mechanism 61 which decelerates the turning force of the drive motor 60 and relays it, a shaft 62 which rotates as a result of the turning force relayed by the gear transmission mechanism 61, a pair of active rollers fitted at a prescribed interval on to the shaft 62, and a passive roller 64 which presses against these active rollers 63.

As FIG. 16 shows, the passive roller 64 is supported by a shaft 65 in such a manner as to be capable of rotating, while the shaft 65 is constantly energised towards the active rollers 63 with the aid of a coil spring 66. The coil spring 66 is prevented from coming loose by a pressure plate 67 located on the exit bracket 24 which covers the leading edge side of the casing 20, while this pressure plate is fixed to the exit bracket 24 by means of a screw 68.

Around the active rollers 63 is wound, as may be seen in FIG. 16, rubber or a similar elastic body 63*a* with a high friction coefficient, on part of which is formed a protrusion 63*b* with increased diameter. Thus, even if cards which are distorted in a latitudinal direction are fed to the card dispensing port 66, the drive rollers feed them properly.

It will also be seen from FIG. 16 that shaft 65 which supports the passive roller 64 is supported in such a manner as to be capable of moving freely upwards and downwards constantly, while there is constant downward pressure from the coil spring 66, thus enabling the passive roller 64 correctly to track the surface shape of the active rollers 63.

Meanwhile, as FIG. 16 also shows, there are located between the card ejecting means 22 and the leading edge 19*a* of the plurality of cards 19 housed in the card-housing unit 2 a shutter device 70 which serves to open and close a card feed route 68 which is formed between the active rollers 63 and the passive roller 64, and the double feed preventing mechanism which prevents mistakes whereby a plurality of cards 19 is fed simultaneously.

Of these, the shutter device 72 comprises a lever 71 with an L-shaped cross-section which goes in and out of the card feed route 68, and a link device 72 which causes the lever 71 to rotate around a shaft 71*a*, thus opening the card feed route 68.

Of these, the link device 72 consists of a link 73 having a long aperture 73*a* which engages with a protrusion 71*b* formed on the side of the lever 71. The trailing edge 73*b* of the link 73 extends to a position beyond the trailing edge 52*b* of the inclined wall 52 of the slide attitude modifying means 28.

The trailing edge 73*b* of the link 73 comes into contact with the trailing edge of the slide holder 31 in its initial position as shown in FIG. 16, moving towards the right in the drawing as a result of its energising force. In this manner, the lever 71 is made to rotate around the shaft 71*a* in a clockwise direction until it assumes a prescribed angle, when it protrudes into the card feed route 68 and blocks it.

When the contact between the trailing edge 73*b* of the link 73 and the slide holder 31 is released, the energising force of a coil spring 74 which is located between the partition 44 and one end of the link 73 causes the link 73 to move towards the left in the drawing, at the same time causing the lever 71 to rotate anticlockwise around the shaft 71*a* and opening the card feed route 68.

There now follows a detailed description of the double feed preventing mechanism 80.

As may be seen from FIG. 16, the double feed preventing mechanism 80 comprises card attitude correction rollers 81 which adjoin the leading edges 19*a* of the cards 19, and thickness screws 82 which serve to regulate the vertical dimension of the card feed route 68 to roughly the thickness of one card.

Of these, the card attitude correction rollers 81 are located, as FIG. 13 shows, as a pair separated by a prescribed interval (an interval smaller than the width of the cards which are to be fed) on the card feed route in the latitudinal direction.

Figure 17:
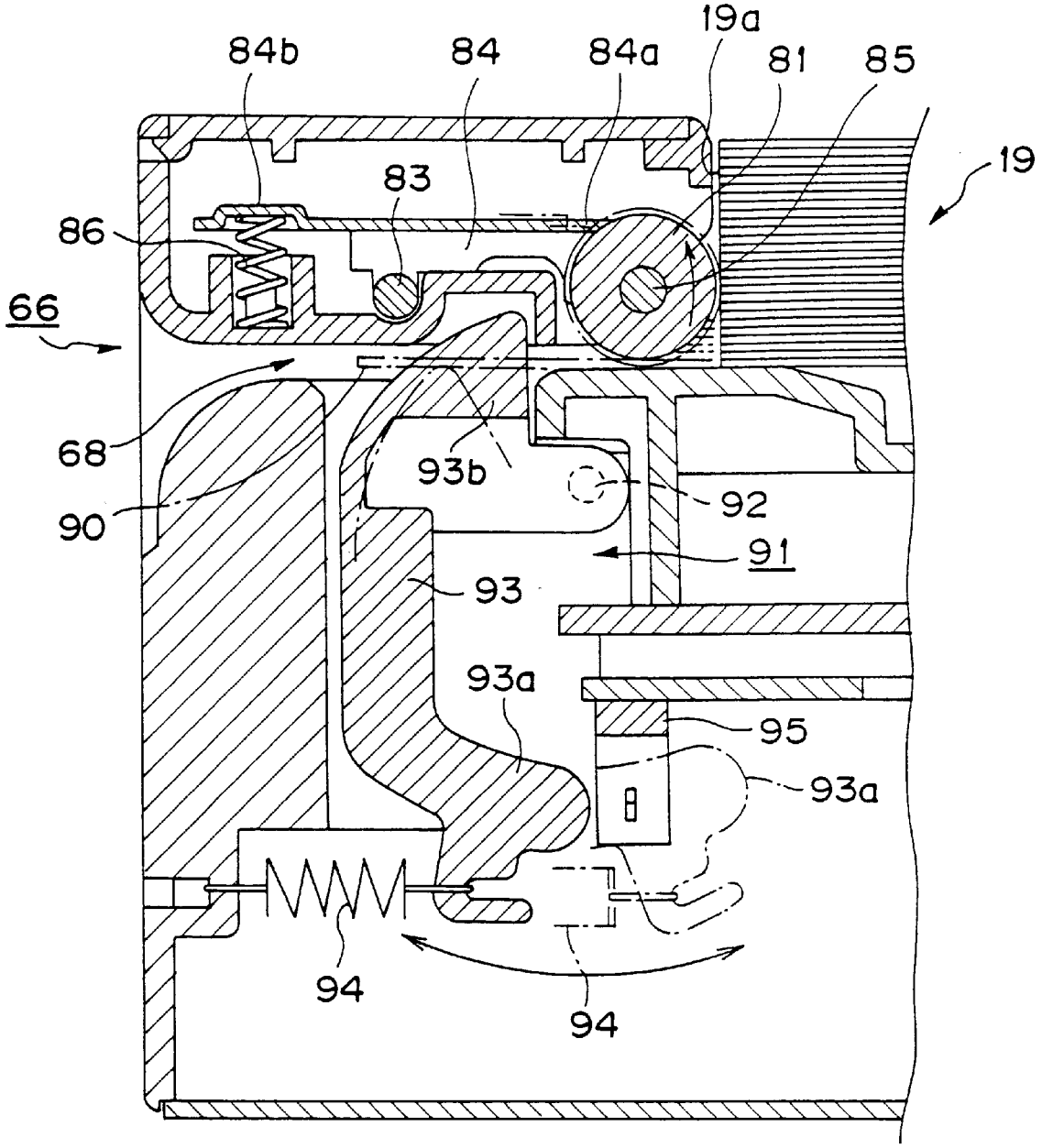
FIG. 17 is a cross-section along the line XVII—XVII of FIG. 13.

FIG. 17 is a cross-section along the line XVII—XVII of FIG. 13. As FIG. 17 shows, these card attitude correction rollers 81 are supported by way of a shaft 85 on one end 84*a* of a roller arm 84 in such a manner as to be capable of rotating freely. The centre of the roller arm 84 is supported by a shaft 83 in such a manner as to be capable of rotating freely. The other end 84*b* of the roller arm 84 is constantly energised in an upward direction by virtue of a coil spring 86. As a result, the whole of the roller arm 84 is energised in a clockwise direction around the shaft 83, so that the card attitude correction rollers 81 are constantly pressed against the lower surface of the card feed route 68. The fact that each of the card attitude correction rollers 81 has its own independent roller arm 84 allows the attitude of any cards which are distorted in a latitudinal direction to be effectively corrected by virtue of the force applied.

In other words, as FIG. 17 shows, even if as a result of frictional force and other factors acting from the leading edge 19*a* of the cards 19 a plurality of cards is fed simultaneously, as indicated by the one-dot chain line, the card attitude correction rollers 81 press the cards forcibly against the lower surface of the card feed route by virtue of the coil springs 86, thus separating them one by one, and at the same time correcting their attitude. If a plurality of cards is fed, the card attitude correction rollers 81 retract upwards as indicated by the one-dot chain line.

Code 91 in FIG. 17 is a second detection means 91 whereby the presence or absence of cards passing along the card feed route 68 is detected. The second detection means 91 comprises a card detection lever 93 which is supported in such a manner as to be capable of rotating freely around a shaft 92, a return spring 94 which engages with the lower end 93*a* of the card detection lever 93 and constantly energises the lever 91 in a clockwise direction around the shaft 92, and a sensor 95 consisting of elements which emit and receive light in order to detect by means of its lower end 93*a* whether or not the card detection lever 93 has rotated through the prescribed angle.

In accordance with the second detection means 91, if one card 90 passes along the card feed route 68 and comes into contact with the leading edge 93*b* of the card detection lever 93, thus causing it to rotate anticlockwise around the shaft 92 as denoted by the one-dot chain line, the trailing edge 93*a* of the lever 93 also rotates in an anticlockwise direction around the shaft 92, cutting across the sensor 95 as shown by the one-dot chain line. Thus, the second detection means 91 transmits an ON signal to a control device (not illustrated in the drawings), detecting the presence of a card 90 in the position of the card detection lever 93 on the card feed route 68.

When the card 90 passes along the card feed route 68 and the lever 93 returns to its initial position as denoted by the unbroken line in FIG. 17, the trailing edge 93*a* of the lever 93 distances itself from the sensor 95, as a result of which the second detection means 91 transmits an OFF signal, detecting the absence of a card 90 in the position of the card detection lever 93 on the card feed route 68.

There follows a detailed description of the thickness screws 82 which constitute the other element of the double feed preventing mechanism 80.

Figure 18:
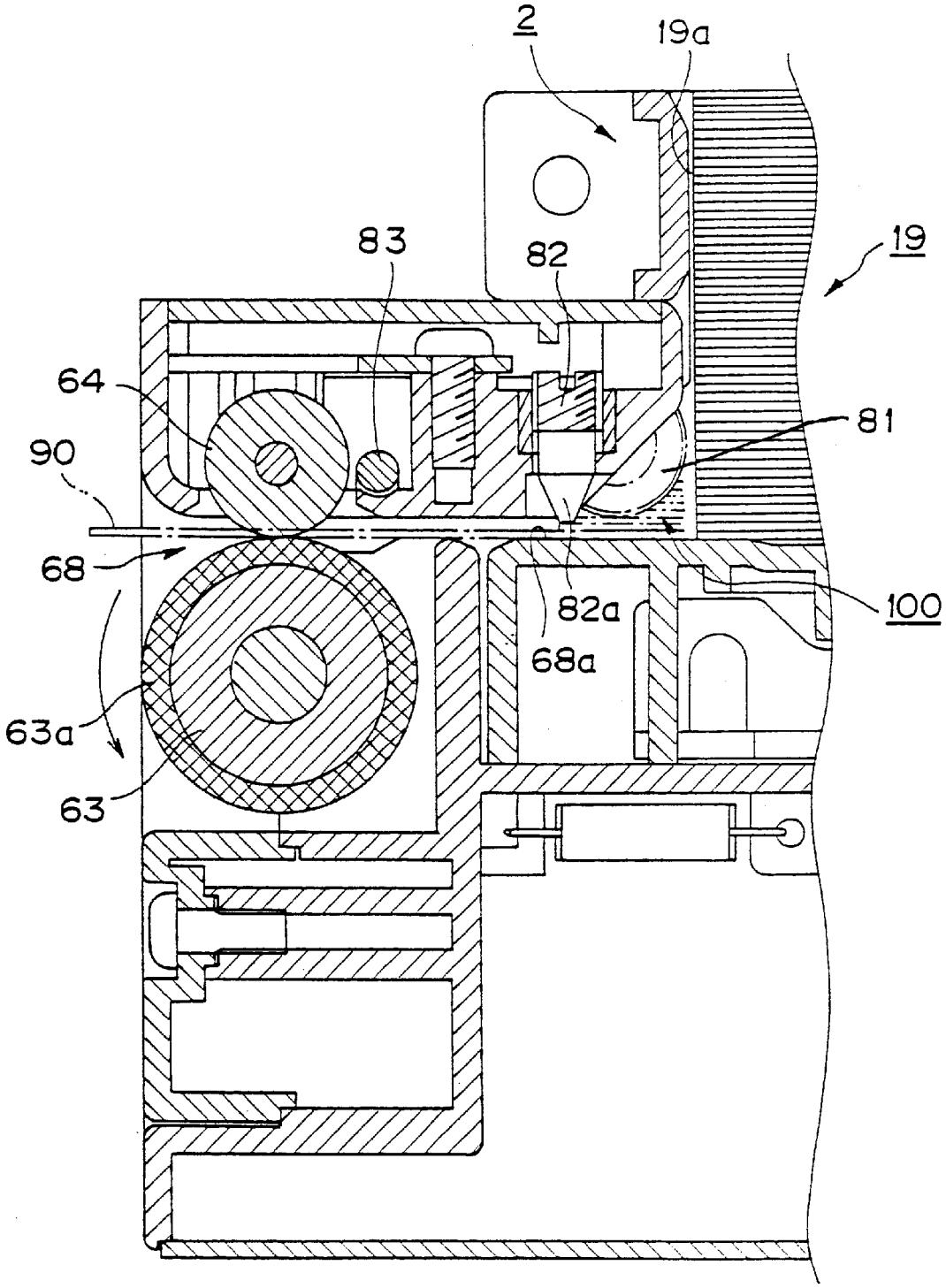
FIG. 18 is a cross-section along the line XVIII—XVIII of FIG. 13.

As may be seen from FIG. 13, these thickness screws 82 are located as a pair separated by a prescribed interval (an interval smaller than the width of the cards which are to be fed) on the card feed route in the latitudinal direction. FIG. 18 is a cross-section along the line XVIII—XVIII of FIG. 13. As FIG. 18 shows, these leading edges of these thickness screws 82 are triangular in shape, and the distance from their leading edges 82*a* to the lower surface 68*a* of the card feed route 68 is set at roughly 1.5 times the thickness of the cards 90 which are fed along the card feed route 68.

Consequently, even if the card attitude correction rollers 81 are unable to prevent the double feeding of cards as denoted by the one-dot chain line, the thickness screws 82 are set in such a manner that the vertical dimension of the card feed route is greater than the thickness of one card and smaller than the thickness of two cards. (In the embodiment it is restricted to roughly 1.5 times the thickness of one card.) Thus it is possible for only one card to pass the thickness screws 82, and this allows the cards to be separated and fed correctly.

It should be added that the vertical dimension of the card feed route 68 can easily be adjusted by rotating the thickness screws 82 in accordance with the thickness of the cards.

Next, there follows a step-by-step description of the process of dispensing cards by means of the card-dispensing device 1.

When a signal to dispense a card is transmitted to the control device (not illustrated in the drawings) of the card-dispensing device 1, the control device switches the power supply on. Then, after a period of time T1 has elapsed, drive signals are transmitted to the first drive motor 40 of the slide driving means 26 illustrated in FIG. 16, and the second drive motor 60 of the card ejecting means 22. These both start up simultaneously, and as a result the slide holder 31 moves with the aid of the reciprocating slider 34 of the reciprocating slider link mechanism 33 from the initial position illustrated in FIG. 16 towards the left in the drawing (in an outward direction). Moreover, the pair of drive rollers 63 of the card ejecting means 22 rotate with the aid of the gear transmission mechanism 61 in an anticlockwise direction at a fixed rate of rotation as denoted by the arrow G.

Figure 19:
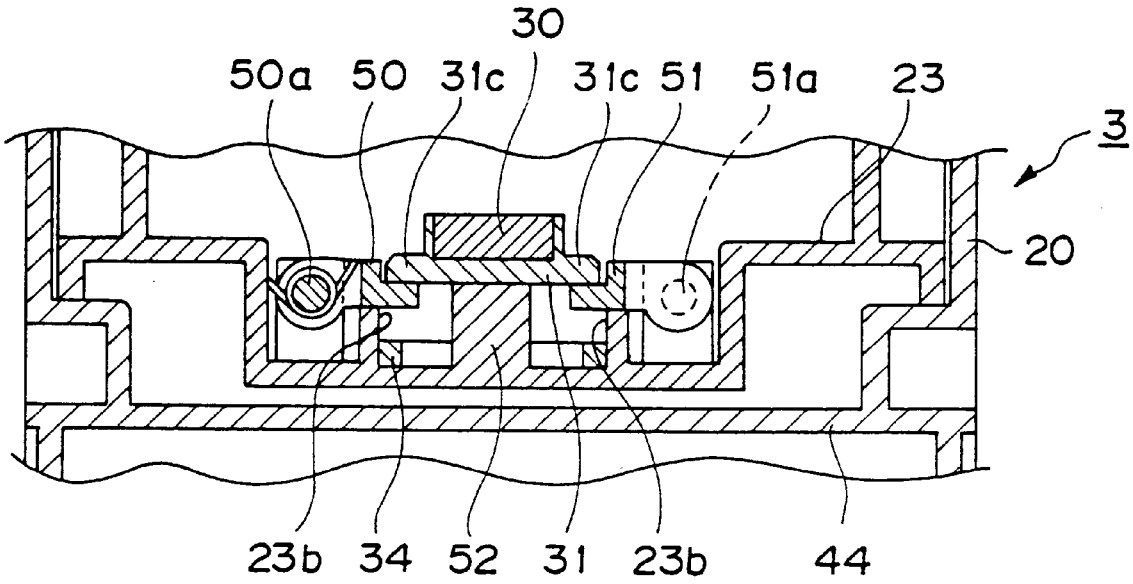
FIG. 19 is a conceptual cross-section of slide attitude modifying means.
Figure 20:
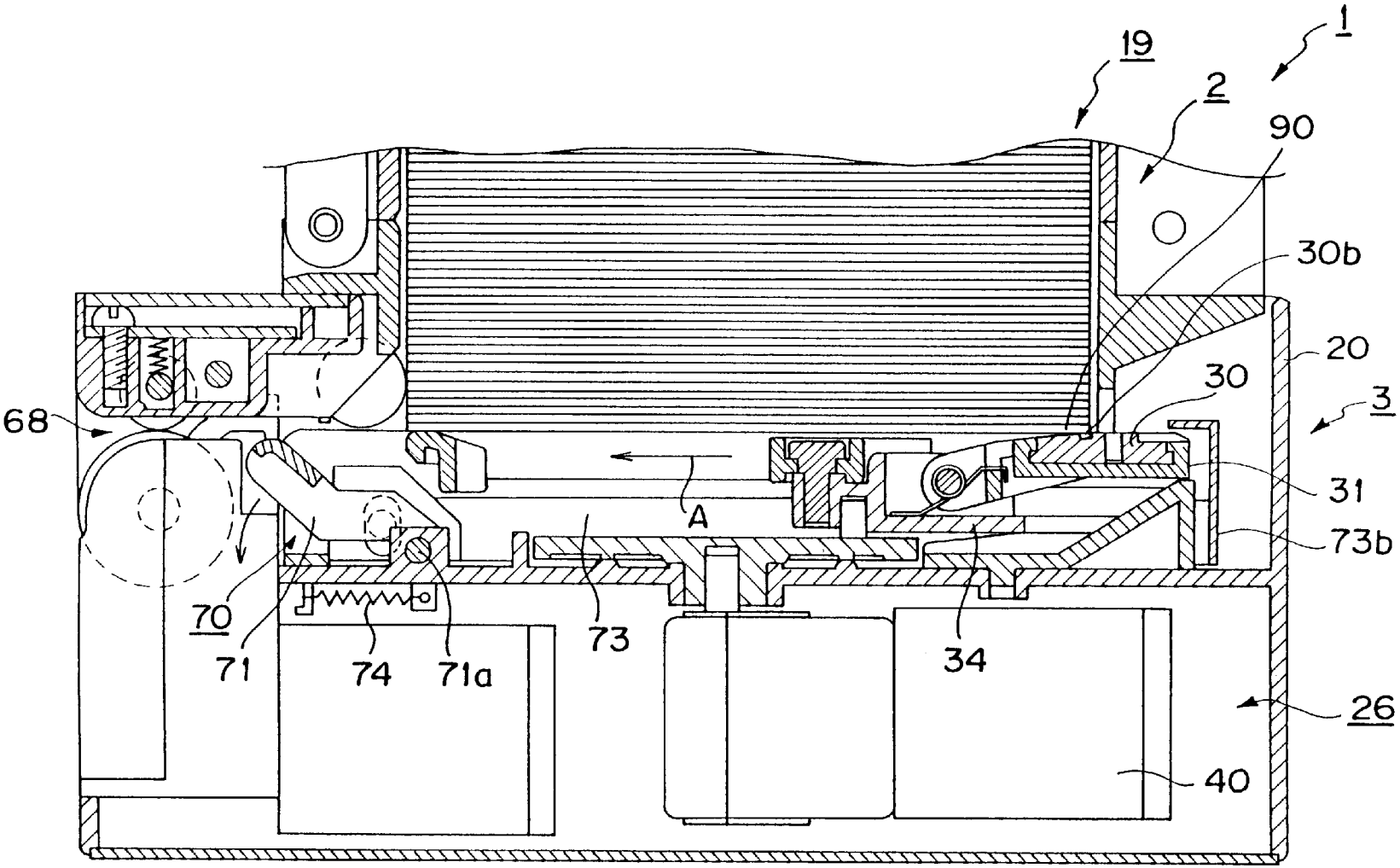
FIG. 20 is a conceptual cross-section illustrating the action of the card-dispensing unit.

When the slide holder 31 moves from the initial position illustrated in FIG. 16 towards the left in the drawing, at first the pair of guide protrusions 31*c* which are formed on its trailing edge as illustrated in FIG. 13 are guided along the pair of guides for changing the attitude of the slide 50, 51. FIG. 19 is a cross-section showing the pair of guide protrusions 31*c* being guided along the pair of guides for changing the attitude of the slide 50, 51.

As a result, the main slide body 30 moves towards the left of FIG. 13 (in the direction of the arrow A) while maintaining an attitude which is parallel with the cards, namely the horizontal attitude represented by the one-dot chain line in FIG. 15.

Thus, as the main slide body 30 moves in the direction of the arrow A (in an outward direction) while maintaining a horizontal attitude with the aid of the pair of guides for changing the attitude of the slide 50, 51, first the contact between the trailing edge 73*b* of the link of the shutter device 70 and the trailing edge of the slide holder 31 is released. This means that the link moves to the left of the drawing by virtue of the energising force of the coil spring 74, while at the same time the shutter lever 71 rotates anticlockwise around the shaft 71*a* to open the card feed route 68.

Next, the step section 30*b* which is formed on the upper surface of the main slide body 30 comes into contact with the trailing edge of the card 90 which is lowermost of the cards 19 stacked and housed within the card-housing unit 2. At this point the detection signal of the first detection means (not illustrated in the drawings), which detects whether the reciprocating slider 34 is in the initial position shown in FIG. 16 or not, changes from OFF to ON.

Figure 21:
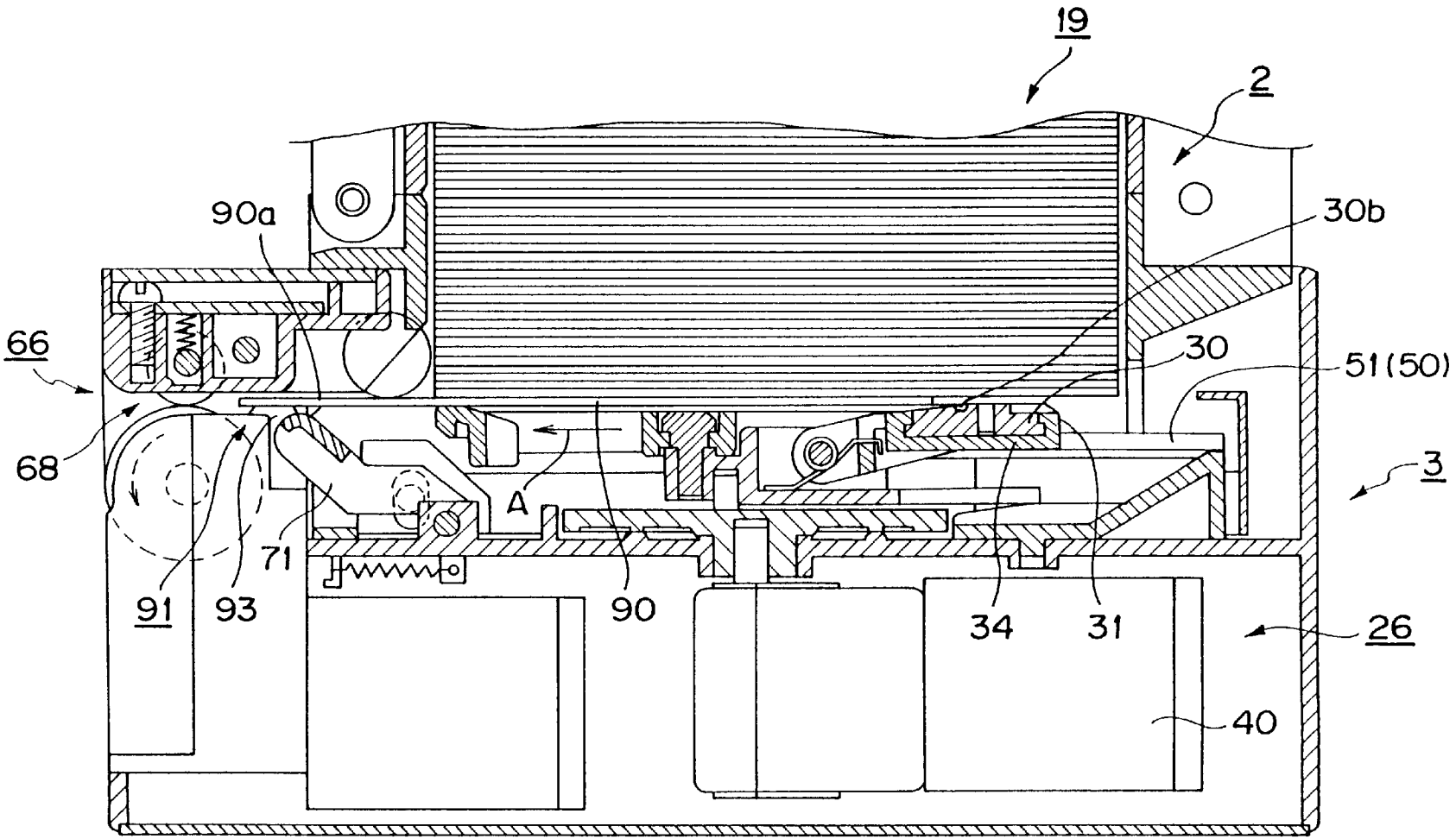
FIG. 21 is a conceptual cross-section illustrating the action of the card-dispensing unit.

After this, if the first drive motor 40 of the slide driving means 26 continues to rotate, the card 90 which has come into contact with the step section 30*b* of the main slide body 30 is pushed out horizontally from the lower surface of the card-housing unit 2, as illustrated in FIG. 21, and moves along the card feed route 68 towards the card ejection port 66.

When the card 90 has been pushed out horizontally in this manner and moves along the card feed route 68 towards the card ejection port 66, it causes the card detection lever 93 of the second detection means 91 to rotate in an anticlockwise direction, thus changing the detection signal of the second detection means 91 from OFF to ON.

When the detection signal of the second detection means 91 changes to ON, the control device (not illustrated in the drawings) drives the first drive motor 26 of the slide driving means 26 in accordance with the ON signal for a period of time T2 thereafter.

Figure 22:
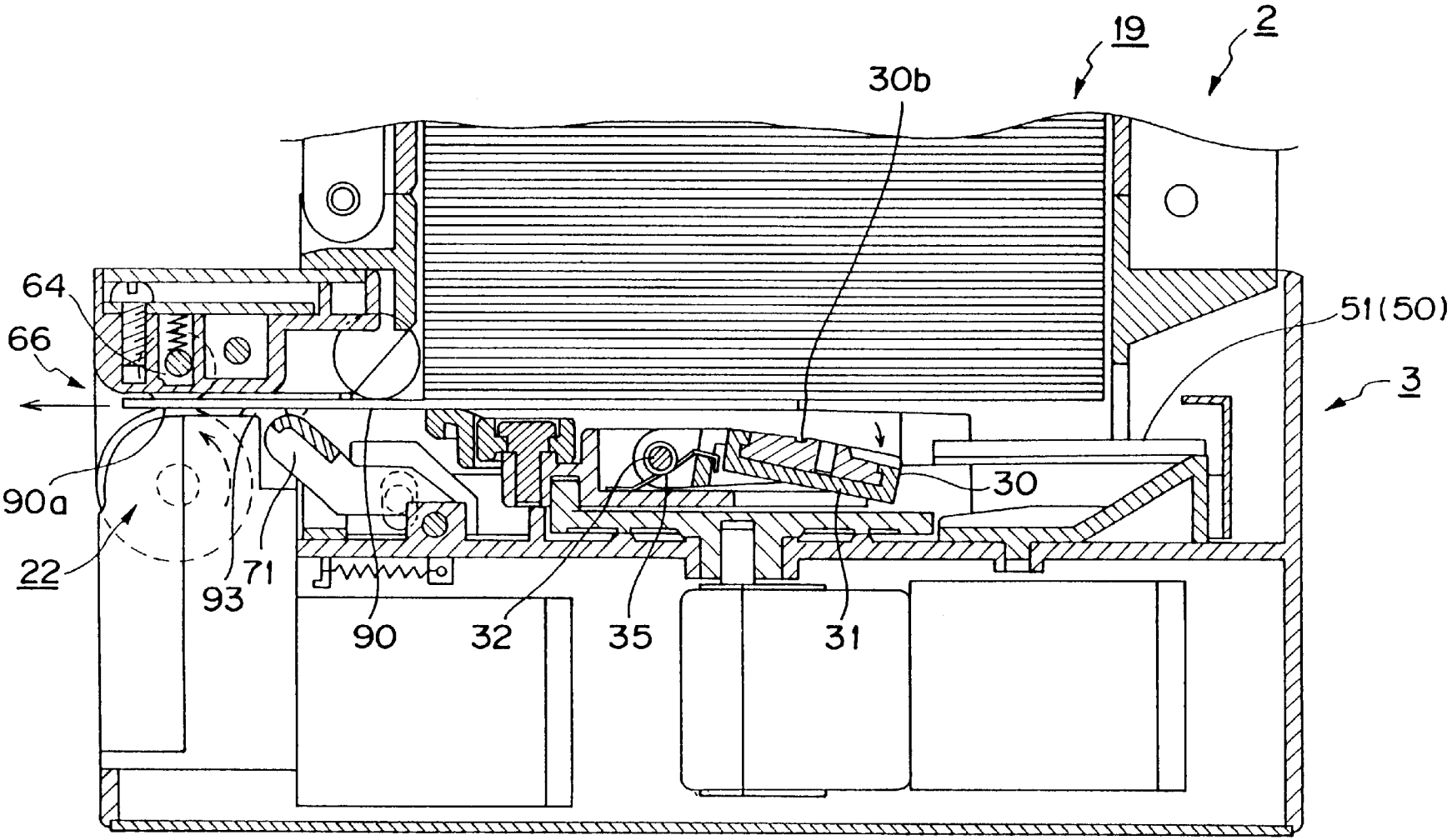
FIG. 22 is a conceptual cross-section illustrating the action of the card-dispensing unit.

In other words, when the drive motor 40 drives the first drive motor 26 for the period of time T2 thereafter, the main slide body 30 moves during that time on the slide holder 31 from the position illustrated in FIG. 21 a prescribed distance in the direction of the arrow A (outward direction) while still maintaining its horizontal attitude by virtue of the pair of guides for changing the attitude of the slide 50, 51. When it has moved as far as the point at which it ends its outward run and begins its inward run, it halts, but the slide holder 31 continues to move in the direction of the arrow A. Meanwhile, as FIG. 22 shows, the guide protrusions 31*c* of the slide holder 31 (FIG. 13) become detached from the guides for changing the attitude of the slide 50, 51, as a result of which the slide holder 31 rotates swiftly in a clockwise direction around the shaft 32 by virtue of the energising force of the coil spring 35. At the same time, the main slide body 30 is caused to incline through a prescribed angle of rotation around the shaft 32, assuming an inclined attitude wherein it is separated from the card 90.

When the main slide body 30 assumes an inclined attitude at a prescribed angle in this manner, contact between the step section 30*b* of the main slide body 30 and the card 90 is released, as is the action of pushing the card 90 by the main slide body 30. At the same time, other contact with the card is also released, and for a while the leading edge 90a of the card 90 is held between the pair of active rollers 63 and the passive roller 64 of the card ejecting means 22. In this manner the card 90 is fed further in the direction of the card ejection port 66 by the feeding force of the active rollers 63.

As the card 90 is fed further in the direction of the card ejection port 66 by the feeding force of the active rollers 63 as in FIG. 22, its trailing edge passes over the card detection lever 93 of the second detection means. As a result the card detection lever 93 returns to its initial position, and the detection signal of the second detection means 91 changes from ON to OFF.

Figure 23:
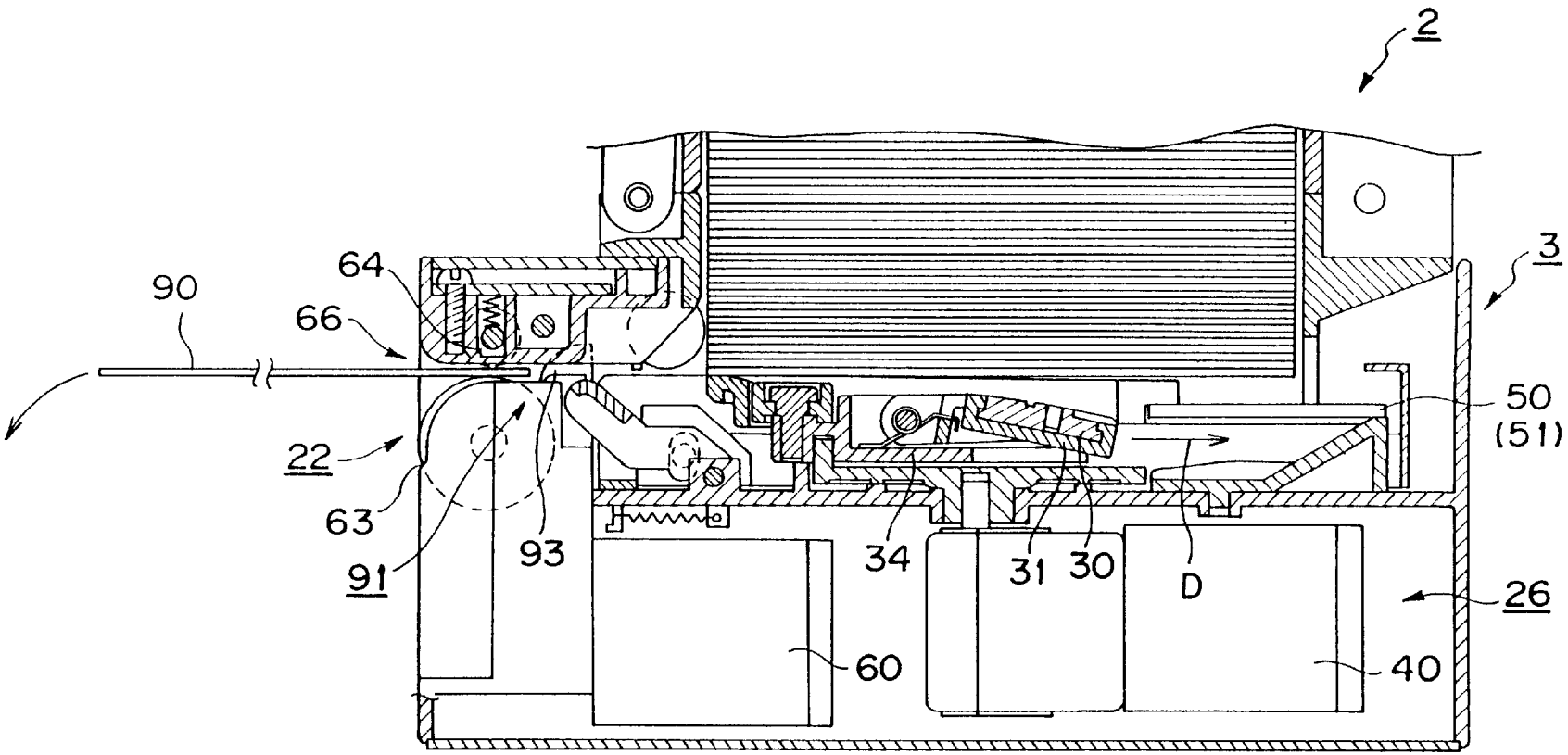
FIG. 23 is a conceptual cross-section illustrating the action of the card-dispensing unit.

When the detection signal of the second detection means 91 changes from ON to OFF in this manner, on the basis of this OFF signal the control device (not illustrated in the drawings) starts up the first drive motor 40 of the slide driving means 26 again. Also on the basis of the OFF signal the second drive motor 60 of the card ejecting means 22 halts after a period of time T3. Meanwhile, as FIG. 23 shows, one card 90 is dropped from between the pair of active rollers 63 and the passive roller 64, and is ejected.

Figure 24:
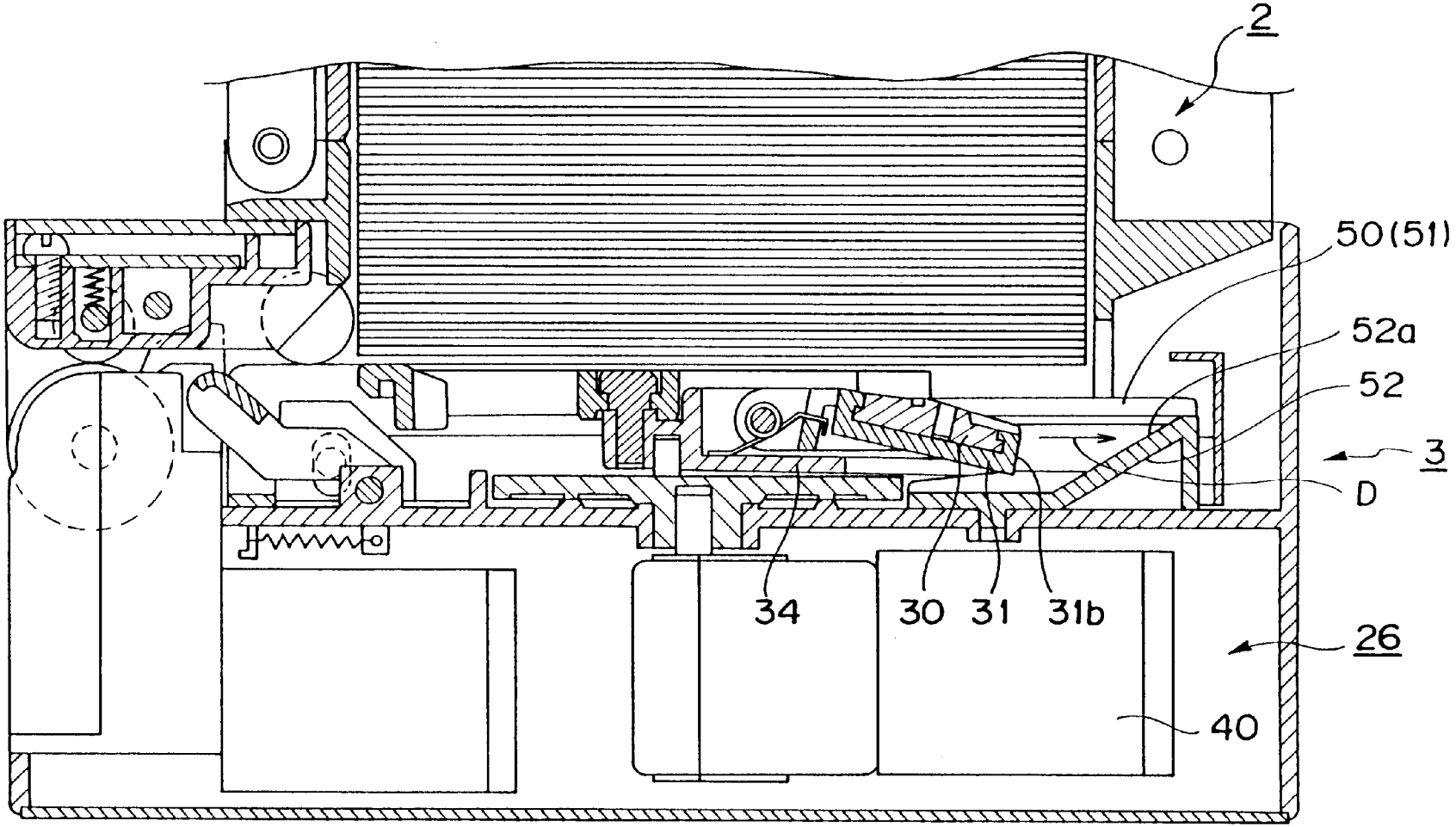
FIG. 24 is a conceptual cross-section illustrating the action of the card-dispensing unit.

When the first drive motor 40 of the slide driving means 26 starts up again, the reciprocating slider 34 commences its inward run as shown in FIG. 24, moving towards the right in the drawing, in the direction of the arrow D.

At that time the main slide body 30 moves on the slide holder 31 while maintaining its inclined attitude. As a result, the pair of guide protrusions 31*c* which are formed on the trailing edge 31*b* of the slide holder 31 (FIG. 13) fail to engage with the pair of guides for changing the attitude of the slide 50, 51, and the inclined attitude is maintained while the slide holder 31 passes beneath the pair of guides for changing the attitude of the slide 50, 51.

Figure 25:
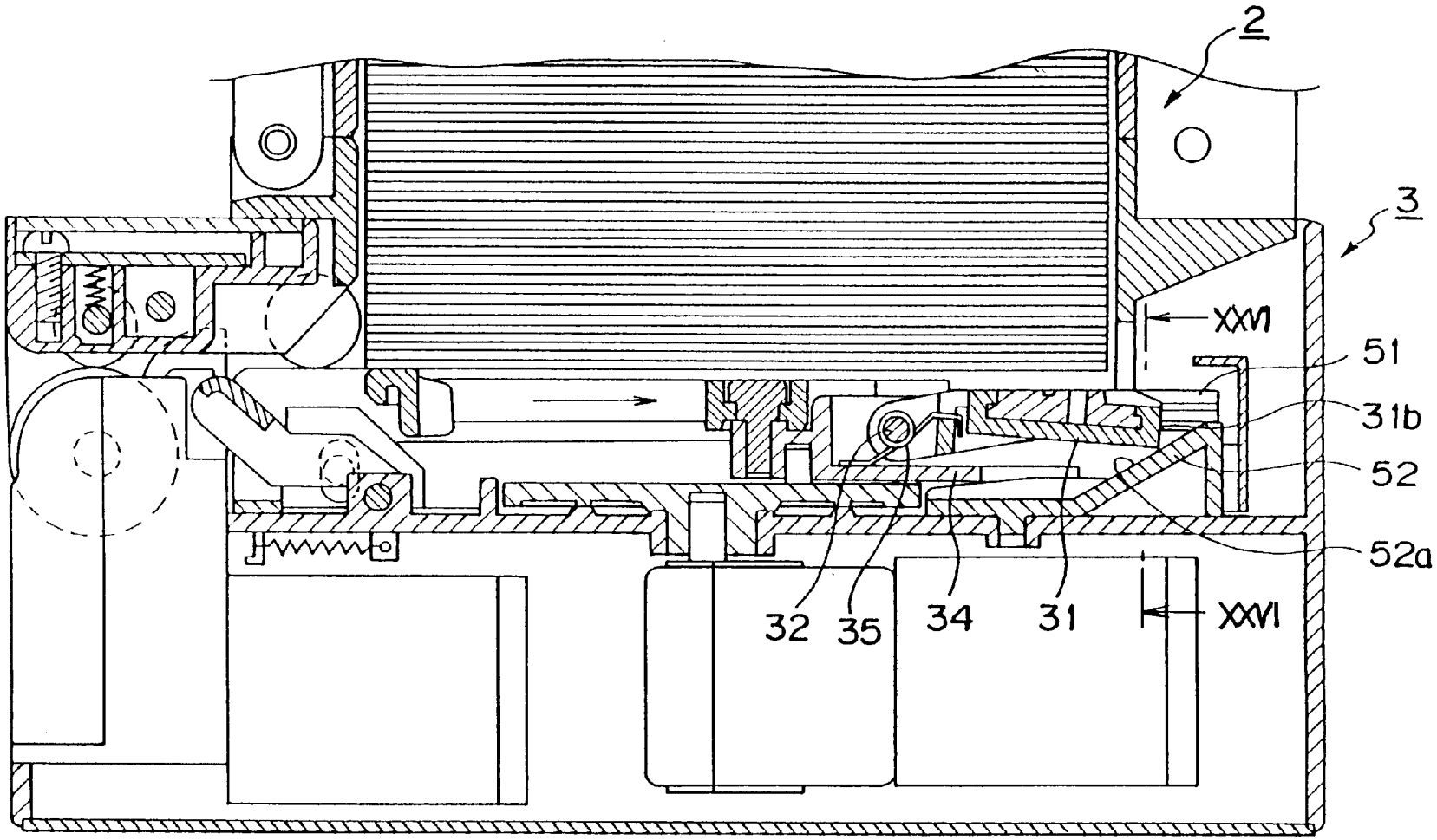
FIG. 25 is a conceptual cross-section illustrating the action of the card-dispensing unit.

When the trailing edge 31*b* of the slide holder 31 reaches the beginning of the inclined wall as illustrated in FIG. 25, the inclined surface 52*a* causes it to resist the energising force of the coil spring 35 and rotate gradually in an anticlockwise direction around the shaft 32, thus gradually regaining its horizontal attitude.

Figure 26:
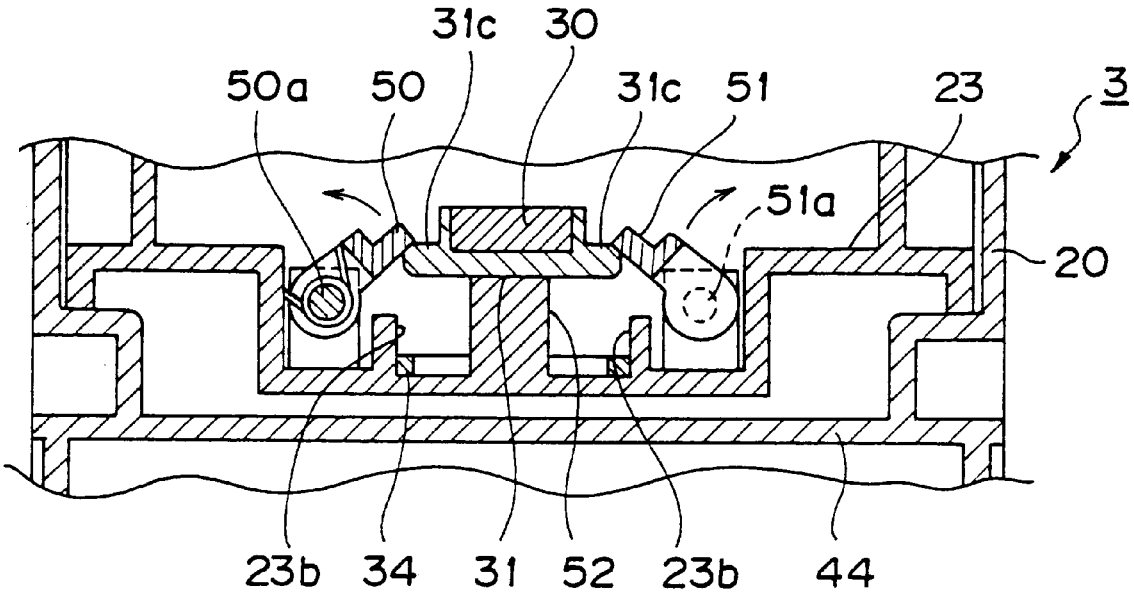
FIG. 26 is a cross-section along the line XXVI—XXVI of FIG. 25.

FIG. 26 is a cross-section along the line XVI—XVI of FIG. 25. As FIG. 26 shows, when the slide holder 31 passes beneath the pair of guides for changing the attitude of the slide 50, 51, the guide protrusion 31*c* of the slide holder 31 comes into contact with the pair of guides for changing the attitude of the slide 50, 51 from below. In doing so, it causes one of the pair of guides for changing the attitude of the slide 50 to rotate anticlockwise around the shaft 50*a*, and the other 51 to rotate clockwise around the shaft 51*a*, thus opening the return route for the slide holder 31 to pass along.

After that, the slide holder 31 regains its initial attitude as illustrated in FIG. 16, and at the same time the pair of guides for changing the attitude of the slide 50, 51 return to their initial horizontal attitude.

When the slide holder 31 regains its initial attitude parallel with the cards as illustrated in FIG. 16, the trailing edge 73*b* of the link of the shutter device 70 and the slide holder 31 come into contact, at which time the energising force causes the link 73 to move to the right. This causes the shutter lever 71 to rotate through a prescribed angle in a clockwise direction around the shaft 71*a*, closing the card feed route 68 again.

When the shutter lever 71 rotates in a clockwise direction around the shaft 71*a* and closes the card feed route 68 again, the pressure of the shutter lever 71 causes the plurality of cards 100 indicated by the one-dot chain lines in FIG. 18 to be returned to their initial position dented by the unbroken lines within the card-housing unit 2.

When the slide holder 31 regains its initial attitude as illustrated in FIG. 16 in preparation for the dispensing of another card, the detection signal of the first detection means (not illustrated in the drawings), which detects whether or not the reciprocating slider 34 is in its initial position as illustrated in FIG. 16, changes from ON to OFF. On the basis of this detection signal, the control device (not illustrated in the drawings) stops the first drive motor 40 of the slide driving means 26. When a period of time T4 has elapsed after the detection signal of the first detection means changed from ON to OFF, the control device then switches the power supply (not illustrated in the drawings) off.

Thereafter the above action is repeated when a signal to dispense a card is transmitted to the control device.

Figure 27:
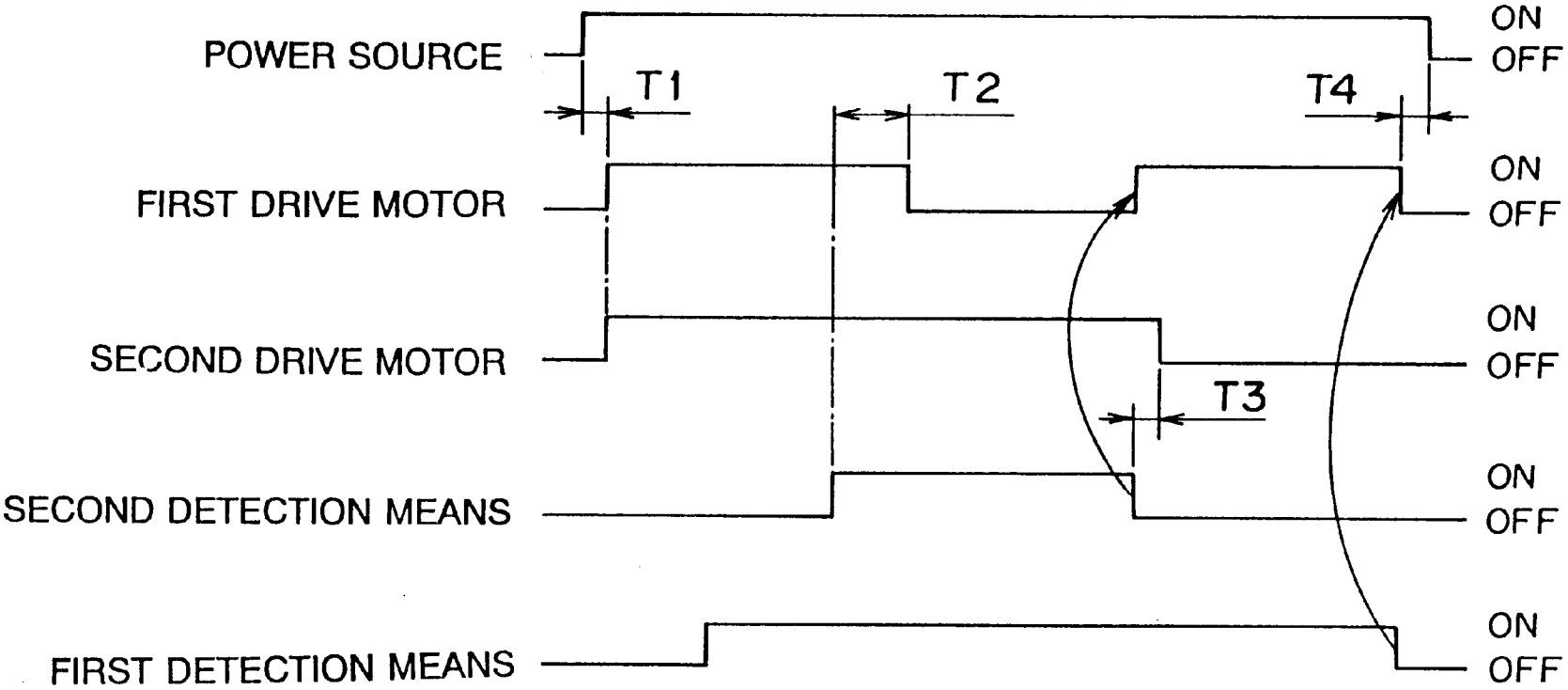
FIG. 27 is a time-chart for dispensing cards.

FIG. 27 is a time-chart for dispensing cards.

Figure 28:
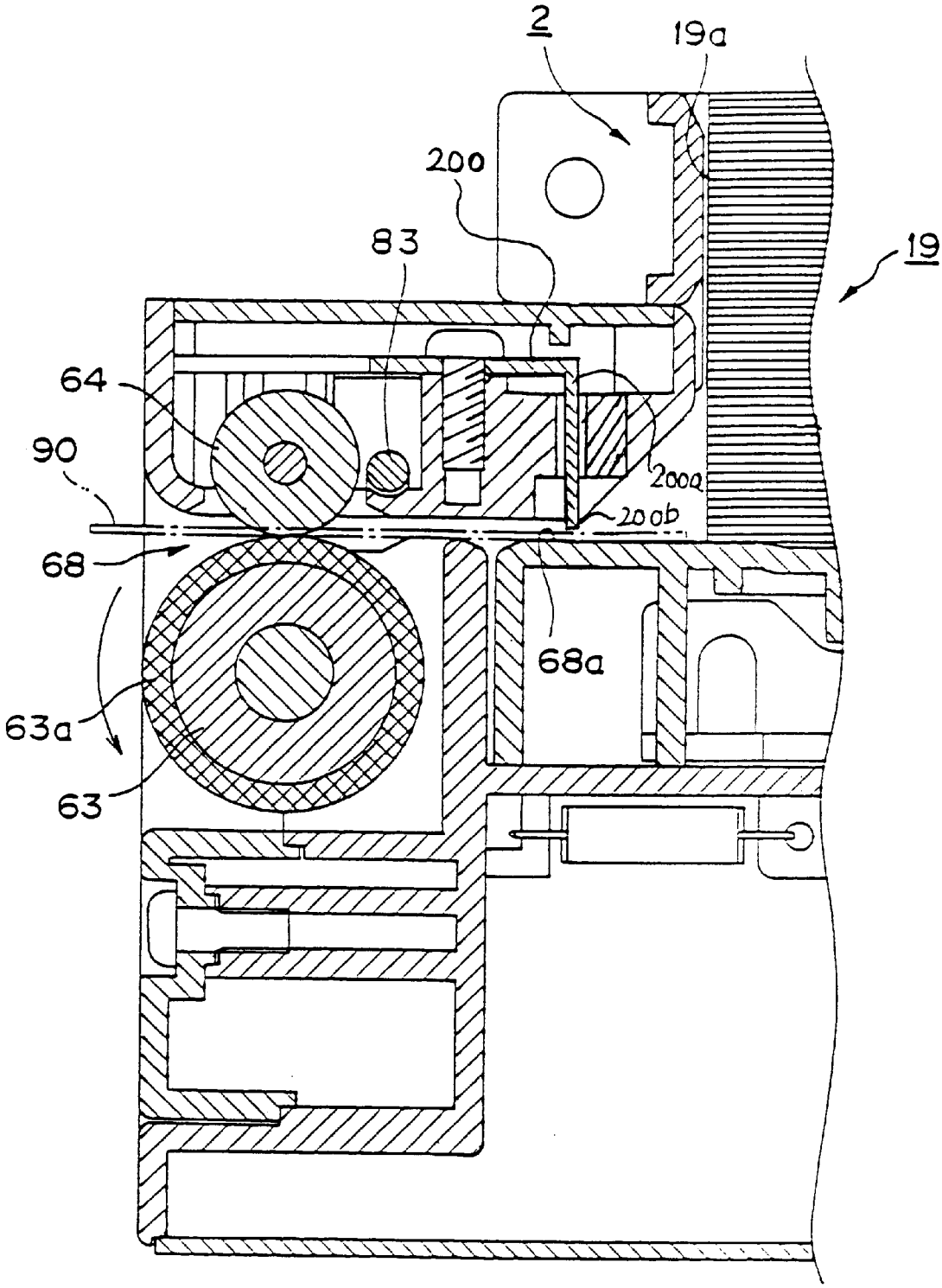
FIG. 28 is a conceptual cross-section illustrating another embodiment of the double feed preventing mechanism.

In the above-described embodiment, a part of the double feed preventing means 80 is constituted by the card attitude correction rollers 81 and thickness screws 82. In the case where cards 90 to be handled in the card-dispensing device are comparatively thick, it is unlikely that the cards bend. Therefore, the card attitude correction rollers are unnecessary. Further, when the cards 90 have a comparatively large thickness, the thickness is generally constant among the cards. Therefore, as shown in FIG. 28 in which the same reference numbers are used as in FIG. 18 to indicate the components that are the same components in FIG. 18, there is provided a plate 200 for covering the passive roller 64 with one end thereof being bent to form a vertical portion 200*a* such that a pair of leading edges 200*b* of the plate 200 are provided with a space therebetween that is narrower than the width of a card to be fed along the transverse direction of the card feed route without using the thickness screws 82. In this case also, the distance from the leading edges 200*a* to the lower surface 68*a* of the card feed route 68 is set at roughly 1.5 times the thickness of the cards 90 which are fed along the card feed route 68.

As has been explained above, the card-dispensing device to which the present invention pertains is configured in such a manner that the slide which engages-with the trailing edge of cards within the card-dispensing unit and pushes them out one by one modifies its attitude during the course of the outward run (while pushing a card) from a horizontal one to one which is inclined through a fixed angle. The inclined slide then forcibly regains its horizontal attitude during the inward run. This means that the attitude of the slide is modified in a swifter and smoother manner than with the conventional structure whereby the slide dropped freely under its own weight during the outward run. In this manner it is possible not only to stabilise the operation of dispensing cards, but also to improve the speed thereof. Moreover, the fact that an inclined wall is employed to force the slide to regain its horizontal attitude during the inward run means that a large amount of space which was conventionally required for this purpose is rendered unnecessary, thus permitting even more compact design of card-dispensing devices.

The present invention may be implemented in a variety of other modes provided that they do not deviate from its intent or principal characteristics. For this reason the foregoing embodiments should be regarded in all aspects as being simple examples, and should be interpreted as in no way restricting its application. The scope of the present invention is indicated by means of the claims, and is in no way constrained by the text of the specification. All modifications and variations which belong within the uniform scope of the claims shall be regarded as falling within the scope of the present invention.

What is claimed is:

1. A card-dispensing device comprising:

a card housing unit wherein a plurality of cards is stacked and housed;

card separating and feeding means for separating the plurality of cards which are stacked and housed in the card housing unit one by one from a bottommost card, and for feeding the separated card along a card feed route which is linked to a card ejection slit;

a shutter device for opening the card feed route when a card is to be dispensed, closing when there is no card to be dispensed, and pushing cards which have been double-fed from the card housing unit by the means for separating and feeding cards back into the card-housing unit; and double feeding preventing means for preventing double feeding of cards by the card separating and feeding means, wherein the double feeding preventing means comprises:

a card attitude correction roller provided in adjacent to leading edges of the cards stacked and housed in the card-housing unit, for pressing cards which have been separated and fed by the card separating and feeding means against a lower surface of the card feed route; and a thickness screw located in the card feed route downstream from the card attitude correction roller, for regulating vertical dimension of the card feed route in such a manner that it is greater than the thickness of one card and smaller than the thickness of two cards.

2. A card-dispensing device comprising:

a card housing unit wherein a plurality of cards is stacked and housed;

card separating and feeding means for separating the plurality of cards which are stacked and housed in the card housing unit one by one from a bottommost card, and for feeding the separated card along a card feed route which is linked to a card ejection slit;

a shutter device for opening the card feed route when a card is to be dispensed, closing when there is no card to be dispensed, and pushing cards which have been double-fed from the card housing unit by the means for separating and feeding cards back into the card-housing unit; and double feeding preventing means for preventing double feeding of cards by the card separating and feeding means;

wherein the shutter device comprises:

an L-shaped lever having one end rotatably supported in around a shaft and another end which enters and exits from the card feed route; and a link device for rotating the lever in one direction around the shaft when the card separating and feeding means is activated so as to open the card feed route, and for rotating the lever in a direction opposite to the one direction around the shaft when the card separating and feeding means is not activated so as to close the card feed route;

and the double feeding preventing means comprises:

a card attitude correction roller provided in adjacent to leading edges of the cards stacked and housed in the card-housing unit, for pressing cards which have been separated and fed by the card separating and feeding means against a lower surface of the card feed route; and a thickness screw located in the card feed route downstream from the card attitude correction roller, for regulating vertical dimension of the card feed route in such a manner that it is greater than the thickness of one card and smaller than the thickness of two cards.

* * * * *